US008315538B2

(12) United States Patent
Takei

(10) Patent No.: US 8,315,538 B2
(45) **Date of Patent: *Nov. 20, 2012**

(54) IMAGE FORMING APPARATUS

(75) Inventor: Yuhei Takei, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/195,277

(22) Filed: Aug. 1, 2011

(65) Prior Publication Data

US 2011/0280624 A1 Nov. 17, 2011

Related U.S. Application Data

(63) Continuation of application No. 12/234,487, filed on Sep. 19, 2008, now Pat. No. 8,014,700.

(30) Foreign Application Priority Data

Sep. 21, 2007 (JP) ..... 2007-246234

(51) Int. Cl.
*G03G 15/08* (2006.01)
*G03G 21/00* (2006.01)

(52) U.S. Cl. ..... 399/121; 399/124

(58) Field of Classification Search ..... 399/121, 399/124, 125

See application file for complete search history.

(56) References Cited

U.S. PATENT DOCUMENTS 6,871,032 B2 3/2005 Iida
7,657,196 B2 2/2010 Yamaguchi et al.

FOREIGN PATENT DOCUMENTS

JP 2001-005235 1/2001
JP 2002-180675 6/2002

*Primary Examiner* — David Gray
*Assistant Examiner* — Gregory H Curran
(74) *Attorney, Agent, or Firm* — Fitzpatrick, Cella, Harper & Scinto

(57) ABSTRACT

An image forming apparatus includes a plurality of image bearing members, a plurality of primary transferring devices, an intermediary transfer unit, a secondary transfer portion, a detecting member, an adjusting device, an openable member, a guiding mechanism, and a retracting mechanism.

16 Claims, 12 Drawing Sheets

IMAGE FORMING APPARATUS

This application is a continuation of U.S. patent application Ser. No. 12/234,487, filed Sep. 19, 2008, which is incorporated by reference herein.

FIELD OF THE INVENTION AND RELATED ART

The present invention relates to an image forming apparatus having multiple image bearing members disposed in tandem under the intermediary transfer belt. More specifically, it relates to the portion of the structure of the image forming apparatus, which supports the member which optically detects a toner image on the intermediary transfer belt immediately after the transfer of the toner image onto the intermediary transfer belt.

There has been put to practical usage an image forming apparatus having multiple image bearing members disposed in tandem under the intermediary transfer belt. Further, an image forming apparatus which forms a control toner image on the image bearing member, transfers the control toner image onto the intermediary transfer belt, and optically detects the control toner image on the intermediary transfer belt to reflect the results of the detection upon the image formation setting for the following image forming operation.

There has been disclosed in Japanese Laid-open Patent Application 2002-180675 a full-color image forming apparatus of the tandem type, which has yellow, magenta, cyan, and black image forming portions, which are disposed under the intermediary transfer belt. The intermediary transfer belt of this image forming apparatus is supported by a pair of belt supporting members, around which the belt is stretched. Further, in order to reduce in size the housing (external shell) without sacrificing the space for the exposing apparatus, this image forming apparatus is structured so that the bottom portion of the loop, which the intermediary transfer belt forms, tilts downward toward the belt supporting member on the downstream side in terms of the belt movement.

Further, the transfer portion for transferring a toner image on the intermediary transfer belt is located at the downstream end of the loop, which the intermediary transfer belt forms; it is located close to the downstream belt supporting member. Hereafter, the loop, which the intermediary transfer belt forms, may be referred to simply as the belt loop. The rotatable member for conveying a recording medium to the transfer portion is located below the downstream belt supporting member. The recording medium storage cassette is located in the bottom portion of the image forming apparatus. As a recording medium is pulled out of the recording medium storage cassette, it is conveyed upward through the vertical recording medium conveyance passage, and then, is sent to the fixing means through the transfer portion.

The intermediary transfer belt, belt supporting upstream member, and belt supporting downstream member are assembled into an intermediary transfer unit. A conventional image forming apparatus, such as the one disclosed in Japanese Laid-open Patent Application 2002-180675, is structured so that when its intermediary transfer unit needs to be moved out of the main assembly of the image forming apparatus, it is upwardly taken out by opening the top wall of the apparatus housing.

Japanese Laid-open Patent Application 2001-005235 discloses a full-color image forming apparatus of the tandem type, which has an optical sensor in addition to yellow, magenta, cyan, and black image forming portions. The four image forming portions are disposed in tandem along the top side of the belt loop, and the optical sensor is positioned to face the portion of the belt loop, which is on the downstream side of the most downstream photosensitive drum to detects the density level of the control toner image transferred (primary transfer) onto the intermediary transfer belt. The results of the detection of the density level of the control toner image are used to properly align (register) the toner images, different in color, in terms of the moving direction of the intermediary transfer belt when the toner images are transferred onto the belt.

In order to reduce in size an image forming apparatus without affecting the image bearing member size and image bearing member intervals, it was studied to reduce the distance between the belt supporting upstream member and belt supporting downstream member in order to reduce the dimension of the belt loop (intermediary transfer belt) in terms of the direction in which the intermediary transfer belt is circularly moved. However, reducing the belt loop in dimension in terms of the above described direction left little room on the belt loop, which the optical sensor could face, making it necessary for the optical sensor to be position so that the optical sensor faces the portion of the belt loop, which curved following the peripheral surface of the belt supporting downstream member.

Further, in order to make it easier to replace the intermediary transfer unit (intermediary transfer belt), it was studied to structure the main assembly of an image forming apparatus so that the main assembly can be separated at the recording medium conveyance passage, into two portions, more specifically, the main portion which holds the image forming portions, and a door unit which can be rotationally moved relative to the main portion to create an opening through which the intermediary transfer unit can be pulled out of the main assembly (FIG. 3).

In the case of the above described structural arrangement, the optical sensor which was positioned so that it faced the portion of the belt loop, which curved following the peripheral surface of the belt supporting downstream member, was also in the space which the intermediary transfer unit passed when it was pulled out of the main assembly. Therefore, the optical sensor interfered with the operation for pulling the intermediary transfer unit out of the main assembly (FIG. 1).

This, it was studies to make the optical sensor removable so that it can be removed before the intermediary transfer unit is pulled out. However, the optical sensor was connected to the wiring, which interfered with the removal or remounting of the optical sensor. Further, a place where the removed optical sensor could be kept had to be devised.

Further, the optical sensor is a very sensitive component. Thus, in the case of an image forming apparatus structured so that the optical sensor has to be removed before the intermediary transfer unit is pulled out, the procedure which has to be followed before the intermediary transfer unit can be pulled out, and the procedure which has to be followed to put the optical sensor back into the position in which it was before it was removed, in order to restart an image forming operation, are very complicated. Therefore, it is highly possible that a user (operator) will forget to remove the optical sensor before pulling the intermediary transfer unit out of the main assembly, which will result in the damage to the optical sensor. It is also highly possible that the optical sensor will fail to be put back into the position in which it was before it was removed, which will result in the reduction in the accuracy with which the optical sensor detects the density level of the control toner image.

SUMMARY OF THE INVENTION

Thus, the primary object of the present invention is to provide an image forming apparatus, which is simpler in the operational procedure for pulling its intermediary transfer unit out of the main assembly of the apparatus, than an image forming apparatus in accordance with the art prior to the present invention.

According to an aspect of the present invention, there is provided an image forming apparatus comprising a plurality of image bearing members; a plurality of primary transferring devices for transferring toner images from said image bearing member onto an intermediary transfer belt provided above said plurality of image bearing members; an intermediary transfer unit including said intermediary transfer belt; a secondary transfer portion for transferring the toner image from said intermediary transfer belt onto a recording material; a feeding path for feeding the recording material upwardly toward said secondary transfer portion; a detecting member for detecting the toner image formed on said intermediary transfer belt; an adjusting device for adjusting a condition under which the image is formed on said image bearing member on the basis of a result of detection of said detecting member; an openable member for opening said feeding path; a guiding mechanism for guiding draw of said intermediary transfer unit toward said feeding path when said openable member opens; and a retracting mechanism for retracting said detecting member away from said intermediary transfer unit with movement of said intermediary transfer unit toward said feeding path.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described in detail with reference to the appended drawings. The following preferred embodiments of the present invention are not intended to limit the present invention in scope. That is, the present invention is applicable to any image forming apparatus, a part, parts, or the entirety of the structural features of which are different from the counterparts in the following embodiments, as long as the image forming apparatus is structured so that the procedure for pulling the intermediary transfer unit out of the main assembly of the apparatus causes the optical sensor to move out of the path of the intermediary transfer unit.

In other words, the present invention is also applicable to an image forming apparatus having no more than 3, or no less than 5, image bearing members, which contact the intermediary transferring member.

What will be described next are the portions of the image forming apparatus, which are essential to the formation and transfer of a toner image. However, not only is the present invention applicable to the image forming apparatus in this embodiment, but also, various image forming apparatuses different from the image forming apparatus in this embodiment, for example, a personal printer, a personal copying machine, a personal facsimile machine, a personal multifunction image forming apparatus, commercial versions of the preceding equipment, etc., which are made up of the portions which will be described next, additional devices, equipment, etc., and a housing (external shell, external frame, or the like).

Embodiment 1

Figure 1:
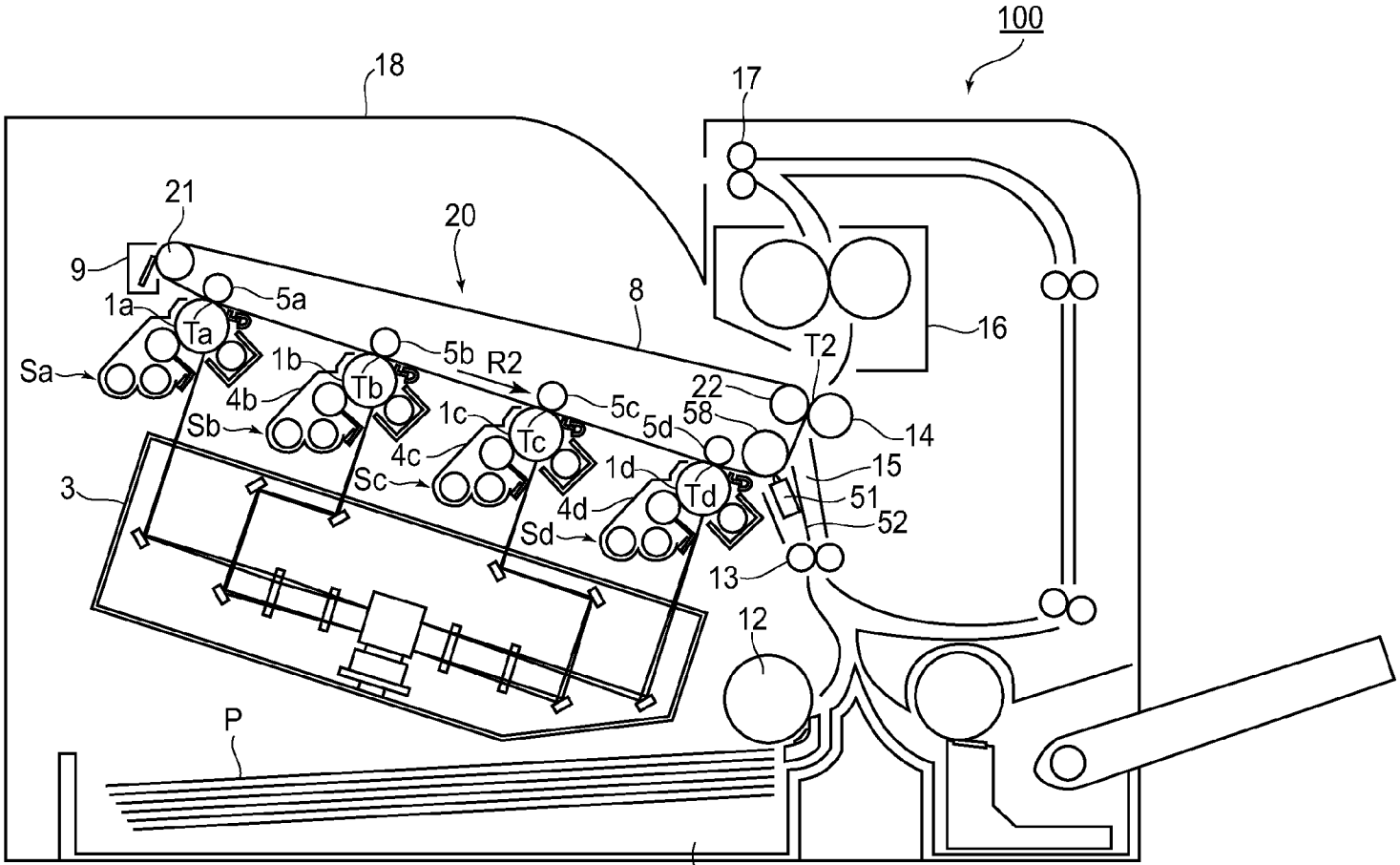
FIG. 1 is a schematic drawing of the image forming apparatus in the first preferred embodiment of the present invention, showing the structure of the apparatus.
Figure 2:
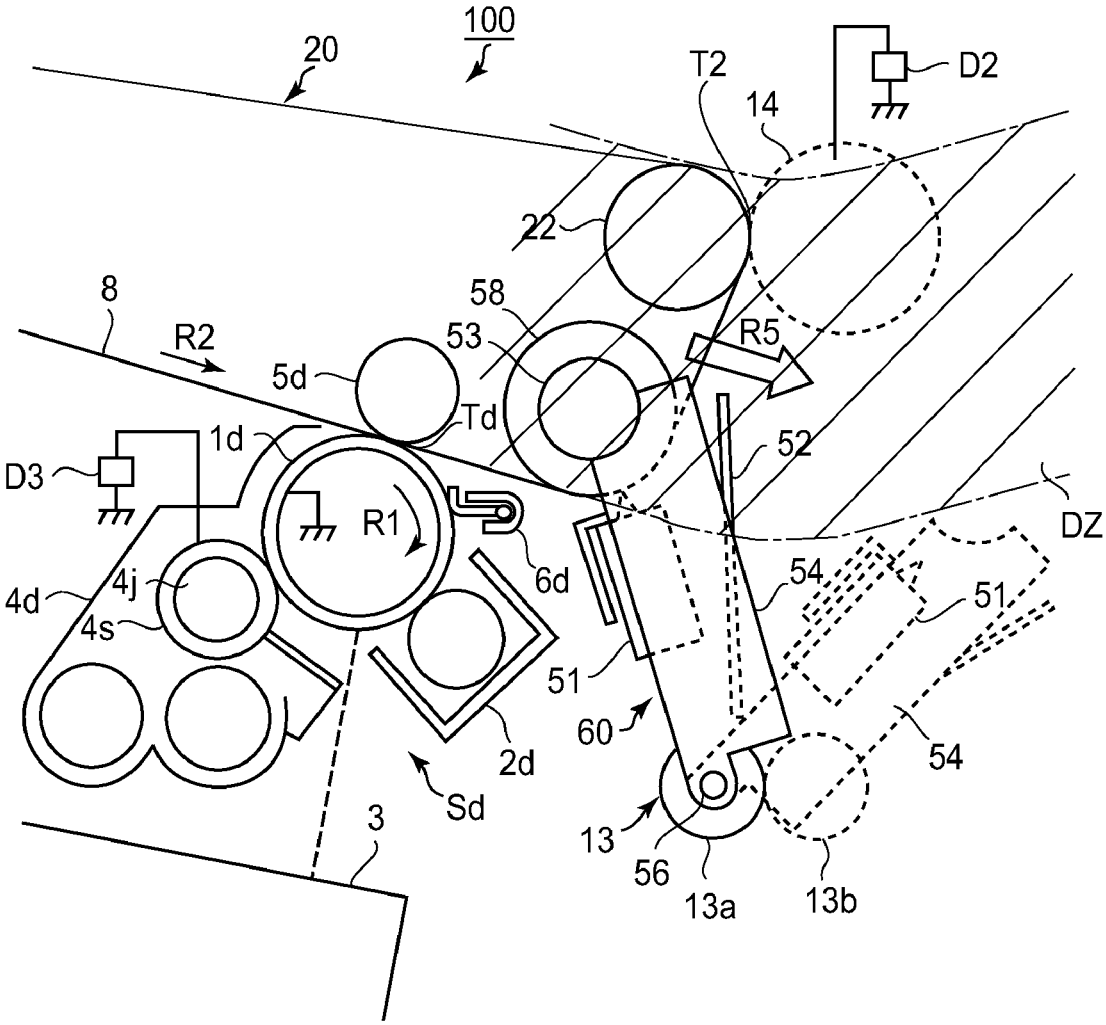
FIG. 2 is a schematic drawing of the image forming portion of the image forming apparatus.

FIG. 1 is a schematic drawing of the image forming apparatus in the first preferred embodiment, and shows the general structure of the apparatus. FIG. 2 is a schematic drawing of the image forming portions of the apparatus, and shows the structure of the portions.

Referring to FIG. 1, the image forming apparatus 100 in the first embodiment is a full-color printer of the so-called tandem type. That is, it has four image forming portions Sa, Sb, Sc, and Sd, and an intermediary transfer belt 8. The four image forming portions are disposed in tandem along the straight portion of the loop which the intermediary transfer belt 8 forms.

In the image forming portion Sa, which is the most upstream image forming portion in terms of the moving direction of the intermediary transfer belt 8, a yellow toner image is formed on a photosensitive drum 1*a*, and then, is transferred (primary transfer) onto the intermediary transfer belt 8 in the primary transfer portion Ta. In the image forming portion Sb, a magenta toner image is formed on a photosensitive drum 1*b*, and then, is transferred (primary transfer) onto the intermediary transfer belt 8 so that it is laid on the yellow toner image on the intermediary transfer belt 8, in the primary transfer portion Tb. In the image forming portions Sc and Sd, a cyan toner image and a black toner image are formed on photosensitive drums 1*c* and 1*d*, respectively, and then, are transferred (primary transfer) onto the intermediary transfer belt 8 in a manner to be laid in layers on the yellow and magenta toner images on the intermediary transfer belt 8, in the primary transfer portions Tc and Td, respectively.

After the four toner images, different in color, are sequentially transferred (primary transfer) onto the intermediary transfer belt 8, they are conveyed by the movement of the intermediary transfer belt 8 to the secondary transfer portion T2, in which they are transferred together (secondary transfer) onto a recording medium P. The transfer residual toner, that is, the toner remaining on the intermediary transfer belt 8 after it is moved through the secondary transfer portion T2, is removed by a belt cleaning apparatus 9.

After the transfer of the four toner images which are different in color, the recording medium P is sent to a fixing apparatus 16, in which the toner images are subjected to heat and pressure, being thereby fixed to the surface of the recording medium P. Thereafter, the recording medium P is discharged into a delivery tray 18.

The recording mediums P are stored in a recording medium cassette 11, and are pulled out of the cassette 11 for image transfer. If two or more recording mediums P are pulled out together, they are separated by a separating apparatus 22, and then, are conveyed one by one to a pair of registration rollers 13. The registration rollers 13 convey each recording medium P to the secondary transfer portion T2, with the timing with which the toner images on the intermediary transfer belt 8 arrive at the secondary transfer portion T2.

The four image forming portions Sa, Sb, Sc, and Sd are the same in structure, although they are different in the color of the toners used by the developing apparatuses 4*a*, 4*b*, 4*c*, and 4*d* disposed next to the image forming portions Sa, Sb, Sc, and Sd, respectively. Hereafter, therefore, only the image forming portion Sd, that is, the most downstream image forming portion, will be described. The descriptions of the image forming portions Sa, Sb, and Sc are the same as that of the image forming portion Sd, except for the suffix of their referential codes; all that is necessary for the description of the image forming portions Sa, Sb, and Sd is to replace the referential suffix d with a, b, or, c.

Referring to FIG. 2, the image forming portion Sd is made up of a photosensitive drum 1*d*, a charging apparatus 2*d*, an exposing apparatus 3*d*, a developing apparatus 4*d*, a primary transfer roller 5*d*, and a cleaning apparatus 6*d*. The apparatuses 2*d*, 3*d*, 4*d*, and 6*d*, and roller 5*d* are disposed in the adjacencies of the peripheral surface of the photosensitive drum 1*d* in a manner to surround the peripheral surface of the photosensitive drum 1*d*. For maintainability, the image forming portion Sd made up of the photosensitive drum 1*d* and developing apparatus 4*d* is integrally placed in a cartridge, being thereby turned into a process cartridge, which is removably mountable in the main assembly of an image forming apparatus.

The photosensitive drum 1*a* is made up of a piece of metallic cylinder, and a photosensitive layer, which is negative in the normal polarity to which it is chargeable. The photosensitive layer is coated on the peripheral surface of the metallic cylinder in a manner to cover virtually the entirety of the peripheral surface of the metallic cylinder. The photosensitive drum 1*d* is rotated at a process speed (100 mm/sec in peripheral velocity) in the direction indicated by an arrow mark R1.

The charging apparatus 2*d* is provided with a charge roller, which is kept pressed upon the peripheral surface of the photosensitive drum 1*d* so that it will be rotated by the rotation of the photosensitive drum 1*d*. While the charge roller is rotated, a combination of DC voltage and AC voltage is applied to the charge roller. As a result, a portion of the peripheral surface of the photosensitive drum 1*d*, which is contact with the charge roller, is uniformly charged to the negative polarity.

The exposing apparatus 3*d* writes an electrostatic latent image of an intended image on the charged portion of the peripheral surface of the photosensitive drum 1*d* by deflecting, with its polygon mirror, the beam of laser light it projects while modulating (turning on or off) the beam of light according to the image formation data obtained by developing the black component of the optical image of the intended image, in a manner to scan the charged portion of the peripheral surface of the photosensitive drum 1*d*.

The developing apparatus 4*d* develops in reverse the electrostatic image on the peripheral surface of the photosensitive drum 1*d* by adhering the negatively charged toner to the exposed points of the electrostatic latent image. The developing apparatus 4*d* has a development sleeve 4*s*, and a stationary magnet 4*j* which is in the hollow of the development sleeve 4*s*. The development sleeve 4*s* is rotated in such a direction that its peripheral surface moves in the opposite direction from the peripheral surface of the photosensitive drum 1*d* in the area in which the two peripheral surfaces are closest to each other, while a development voltage, which is the combination of negative DC voltage and AC voltage, is applied to the development sleeve 4*s* from an electric power source D3.

The primary transfer roller 5*d* forms a primary transfer portion Td between the photosensitive drum 1*d* and intermediary transfer belt 8, by being kept pressed toward the photosensitive drum 1*d*, with the intermediary transfer belt 8 pinched between the primary transfer roller 5*d* and photosensitive drum 1*d*. While the negatively charged toner image on the peripheral surface of the photosensitive drum 1*d* is moved with the intermediary transfer belt 8 through the primary transfer portion Td, a positive DC voltage is applied to the primary transfer roller 5*d* from an electric power source D1. As a result, the toner image is transferred (primary transfer) onto the intermediary transfer belt 8.

The cleaning apparatus 6*d* prepares the peripheral surface of the photosensitive drum 1*d* for the formation of the next toner image by removing the transfer residual toner, that is, the toner remaining on the peripheral surface of the photosensitive drum 1*d* after having moved through the primary transfer portion Td.

Referring to FIG. 2, a secondary transfer roller 14 is kept pressed against a backup roller 22, with the intermediary transfer belt 8 remaining pinched between the two rollers 14 and 22, forming a secondary transfer portion T2 between the intermediary transfer belt 8 and secondary transfer roller 14. The toner images on the intermediary transfer belt 8 are conveyed through the secondary transfer portion T2 with such timing that the toner images are layered on the recording medium P which is conveyed through the secondary transfer portion T2 while remaining pinched between the intermediary transfer belt 8 and secondary transfer roller 14. While the recording medium P, and the toner images on the intermediary transfer belt 8, are moved together through the secondary transfer portion T2, a positive voltage is applied to the secondary transfer roller 14 from an electric power source D2. As a result, the toner images are transferred (secondary transfer) onto the recording medium P.

While a given portion of the intermediary transfer belt 8 is moved through the portion of the intermediary transfer belt loop, which is between the driver roller 58 and secondary transfer portion T2 and is vertical, it is free of the tension which the driver roller 58 applied to the intermediary transfer belt 8, because this portion of the intermediary transfer belt loop is on the immediately downstream side of the driver roller 58. However, the secondary transfer roller 14 is independently driven from the intermediary transfer belt 8, by the driving force directly inputted into the secondary transfer roller 14. Therefore, even while a given portion of the intermediary transfer belt 8 is moved through the abovementioned portion of the intermediary transfer loop, it remains stable (virtually flat) during an image forming operation.

The distance from the primary transfer portion Td of the image forming apparatus 100, that is, the primary transfer portion in which a black toner image is transferred, to the secondary transfer portion T2 of the image forming apparatus 100, is relatively small. Therefore, the length of time between when an electrostatic image is written on the photosensitive drum 1*d* and when the secondary transfer of the toner image is completed is relatively small.

Referring to FIG. 1, the image forming apparatus 100 is designed so that the portion of the recording medium (P) conveyance path, through which the recording medium P is conveyed upward toward the secondary transfer portion (T2), is roughly vertical, and also, is relatively short.

After the recording medium P is roughly horizontally taken out of the recording medium storage cassette 11, it is directed upward by the separating apparatus 12, and then, is conveyed upward by the registration rollers 13 to the fixing apparatus 16 through a recording medium conveyance path 15 and secondary transfer portion T2. That is, the recording medium P is conveyed upward from the registration rollers 13 to the secondary transfer portion T2 so that it will follow the portion of the intermediary transfer belt loop, which is between the driver roller 58 and backup roller 22, that is, the vertical portion of the belt loop.

Therefore, the distance (gap) between the recording medium P and secondary transfer roller 14 becomes fixed before the recording medium P reaches the secondary transfer portion T2, making it difficult for the recording medium P to be charged by the secondary transfer roller 14. Therefore, electrical discharge is unlikely to occur between the recording medium P and intermediary transfer belt 8 immediately before the recording medium P reaches the secondary transfer portion T2. Therefore, it is unlikely for the toner image on the intermediary transfer belt 8 to be unsatisfactorily transferred because of the electrical discharge between the recording medium P and intermediary transfer belt 8.

The image forming apparatus 100 is structured so that the bottom portion of the intermediary transfer belt loop, that is, the portion through which the intermediary transfer belt 8 moves toward the driver roller 58, is tilted downward toward the driver roller 58. Thus, the image forming apparatus 100 is smaller than an image forming apparatus in accordance with the arts preceding the present invention, in terms of the vertical dimension and the dimension parallel to the front (or rear) panel of the apparatus 100.

To describe more concretely, structuring the image forming apparatus 100 so that the bottom portion of the intermediary transfer belt loop is tilted downward toward the driver roller 58 makes it possible to reduce the distance between the photosensitive drum 1*d* to the recording medium storage cassette 11. Further, it makes it possible to position the driver roller 58 and backup roller 22 lower, making it therefore possible to lower the secondary transfer portion T2, reducing thereby the distance from the recording medium storage cassette 11 to the secondary transfer portion T2. In other words, it can shorten the distance the recording medium P is conveyed from the recording medium storage cassette 11 to the pair of discharge rollers 17 through the secondary transfer portion T2 and fixing apparatus 16, making it therefore possible to reduce the image forming apparatus 100 in height.

Further, structuring the image forming apparatus 100 so that the bottom portion of the intermediary transfer belt loop is tilted relative to the horizontal direction makes it possible to shift the tension roller 21, the positioning of which affects the width of the image forming apparatus 100, in the rightward direction of FIG. 1, compared to the position of the tension roller (21) of an image forming apparatus which is not structured so that the bottom portion of the belt loop is tilted relative to the horizontal direction. Thus, it can allow the image forming apparatus 100 to be reduced in width.

However, tilting the abovementioned portion of the belt loop relative to the horizontal direction requires the tension roller 21 to be positioned higher than the driver roller 58. Therefore, tilting the abovementioned portion of the belt loop at a certain angle requires the image forming apparatus 100 to be substantially increased in height. Thus, the angle of the bottom portion of the belt loop is desired to be in a range of 10-25°.

In order to reduce the image forming apparatus 100 in width, foot print, and weight, the intermediary transfer unit 20 of the image forming apparatus 100 was designed to be less in width than a conventional intermediary transfer unit 20. More specifically, the image forming portions Sa, Sb, Sc, and Sd were shifted in position toward the driver roller 58 while being left untouched in width and interval. Further, the tension roller 21 was shifted toward the driver roller 58 by the distance by which the image forming portions were shifted, in order to reduce the length of the bottom portion of the intermediary transfer belt loop.

Therefore, the most downstream primary transfer portion, that is, the primary transfer portion Td for transferring a black toner image, had to be placed much closer to the driver roller 58. Thus, the image forming portion Sd prevented the optical sensor 51 from being positioned in an area where could face the bottom portion of the belt loop. Therefore, the optical sensor 51 had to be positioned in an area where it faces the portion of the belt loop, which was curved by the driver roller 58.

<Detecting Member>

Referring to FIG. 1, in terms of the direction in which the intermediary transfer belt 8 is driven, the detecting member (51) is at a preset location between the point at which the belt loop is made to curve upward by the belt supporting downstream member (58), which supports and tensions the intermediary transfer belt (8), and the secondary transfer portion (T2). The detecting member (51) optically detects the density level of the control toner image borne on the intermediary transfer belt (8).

Therefore, the detecting member (51) detects the density level of the control toner image on the intermediary transfer belt (8) while the portion of the intermediary transfer belt (8) bearing the control toner image is in contact with the belt supporting downstream member (58) which is most stable in rotational speed, in order to ensure that the density level detection process is not affected by the fluctuation in the moving speed of the intermediary transfer belt (8). For example, the fluctuation of the speed of the intermediary transfer belt (8), which occurs in the primary transfer portion (Td) and secondary transfer portion (T2) is unlikely to affect the timing with which an electrostatic latent image is written on the image bearing member (1*d*).

The density level detection process is as follows: First, control toner images are formed on photosensitive drums 1*a*, 1*b*, 1*c*, and 1*d*, one for one, and transferred (primary transfer) onto the intermediary transfer belt 8. Then, the optical sensor 51 projects a beam of infrared light onto the control toner images on the intermediary transfer belt 8, and outputs analog voltage, the magnitude of which corresponds to the intensity of the portion of the beam of the infrared light, which was reflected by the control toner images. The optical sensor 51 functions as a registration mark detection sensor for detecting the control toner image of a registration mark, in addition to a density level detection sensor for detecting the density level of the control toner image of a color patch.

A registration mark is a mark, the toner image of which is formed on the photosensitive drums 1*a*, 1*b*, 1*c*, and 1*d* in order to minimize the misalignment of the toner images, different in color, in terms of the direction perpendicular to the image bearing surface of the intermediary transfer belt 8, by adjusting the timing with which an electrostatic latent image is written on the photosensitive drums 1*a*, 1*b*, 1*c*, and 1*d*. A color patch means one of the color patches, the toner image of which is formed on the photosensitive drums 1*a*, 1*b*, 1*c*, and 1*d*, respectively, so that the density level of the toner image formed under a preset image forming condition can actually be measured to adjust the toner image formation condition (intensity of exposure light, charge voltage, etc.) based on the detected density of the toner images.

An error in the position of the photosensitive drum 1*d*, and an error in the aiming and focusing of the beam of laser light, which can occur due to the errors which occur during the assembly of the image forming apparatus 100, make it impossible for the four toner images, different in color, formed on the photosensitive drum 1*d*, 1*a*, 1*b*, and 1*c*, one for one, to perfectly align, in terms of the direction perpendicular to the image bearing surface of the intermediary transfer belt 8, when the toner images are transferred in layers onto the intermediary transfer belt 8. That is, they result in the formation of a full-color image which suffers from the color deviation attributable to the misalignment (registration error) of the toner images. This is why toner images of a registration mark are formed on the photosensitive drums 1*a*, 1*b*, 1*c*, and 1*d*, one for one, and are transferred onto the intermediary transfer belt 8.

The optical sensor 51 is made up of a light emitting element and a light receiving element, and functions as an apparatus (sensor for detecting toner image of registration mark) for reading the control toner image on the intermediary transfer belt 8 in order to measure the amount of the portion of the beam of light, which was emitted by the light emitting element and was reflected by the control toner image on the intermediary transfer belt 8.

The image forming apparatus 100 determines the amount of the positional deviation of the toner images on the photosensitive drums 1*a*, 1*b*, 1*c*, and 1*d*, one for one, based on the output of the optical sensor 51, and electrically adjusts the beam of laser light by the amount proportional to the amount of the deviation, with the use of its image adjustment portion (image adjusting means). This adjustment can minimize the image forming apparatus 100 in terms of the color deviation, enabling thereby the image forming apparatus 100 to output a high quality image.

The optical sensor 51 must be located downstream of the primary transfer portion Td and upstream of the secondary transfer portion T2, and be capable of detecting the control toner image on the intermediary transfer belt 8, with high degree of accuracy in terms of the focus of the beam of detection light. Therefore, the optical sensor 51 must be placed in an area where the intermediary transfer belt 8 is supported by the driver roller 58 by its inward surface (in terms of belt loop), being therefore unlikely to flutter and/or vary in speed. However, this arrangement is not intended to limit the present invention in terms of the setup for reading the control toner image on the portion of the intermediary transfer belt 8 in contact with the driver roller 58.

Therefore, the optical sensor 51 is located in an area where the intermediary transfer belt loop curves along the peripheral surface of the driver roller 58.

<Intermediary Transfer Unit>

Referring to FIG. 1, the intermediary transfer unit (20) includes the intermediary transfer belt (8), belt supporting downstream member (58), belt supporting upstream member (21), and backup roller (22). The intermediary transfer unit (20) is structured so that the belt supporting upstream member (21) is positioned higher than the belt supporting downstream member (58) and backup roller (22), so that the bottom portion of the belt loop downwardly tilts toward the belt supporting downstream member (58).

The belt supporting upstream member (21) supports the intermediary transfer belt (8) at the opposite end of the belt loop from the belt supporting downstream member (58), from the inward side of the belt loop, creating thereby the bottom portion of the belt loop. The fixing apparatus (16) is fixed in position, and is positioned above the secondary transfer portion (T2), but, lower than the belt supporting upstream member (21).

The intermediary transfer belt 8, driver roller 58, backup roller 22, tension roller 21, and primary transfer rollers 5*a*, 5*b*, 5*c*, and 5*d* are integrally assembled, forming the intermediary transfer unit 20 which is removably mountable in the main assembly of the image forming apparatus 100.

The intermediary transfer belt 8 is stretched around, being thereby suspended by, the driver roller 58, backup roller 22, and tension roller 21. It is rotated at a preset process speed (100 mm/sec in peripheral velocity) in the direction indicated by the arrow mark R2. It is formed of a dielectric resin, such as polycarbonate, polyethyleneterephthalate resin film, and polyfluorovinylidene film.

<Housing Structure>

Figure 3:
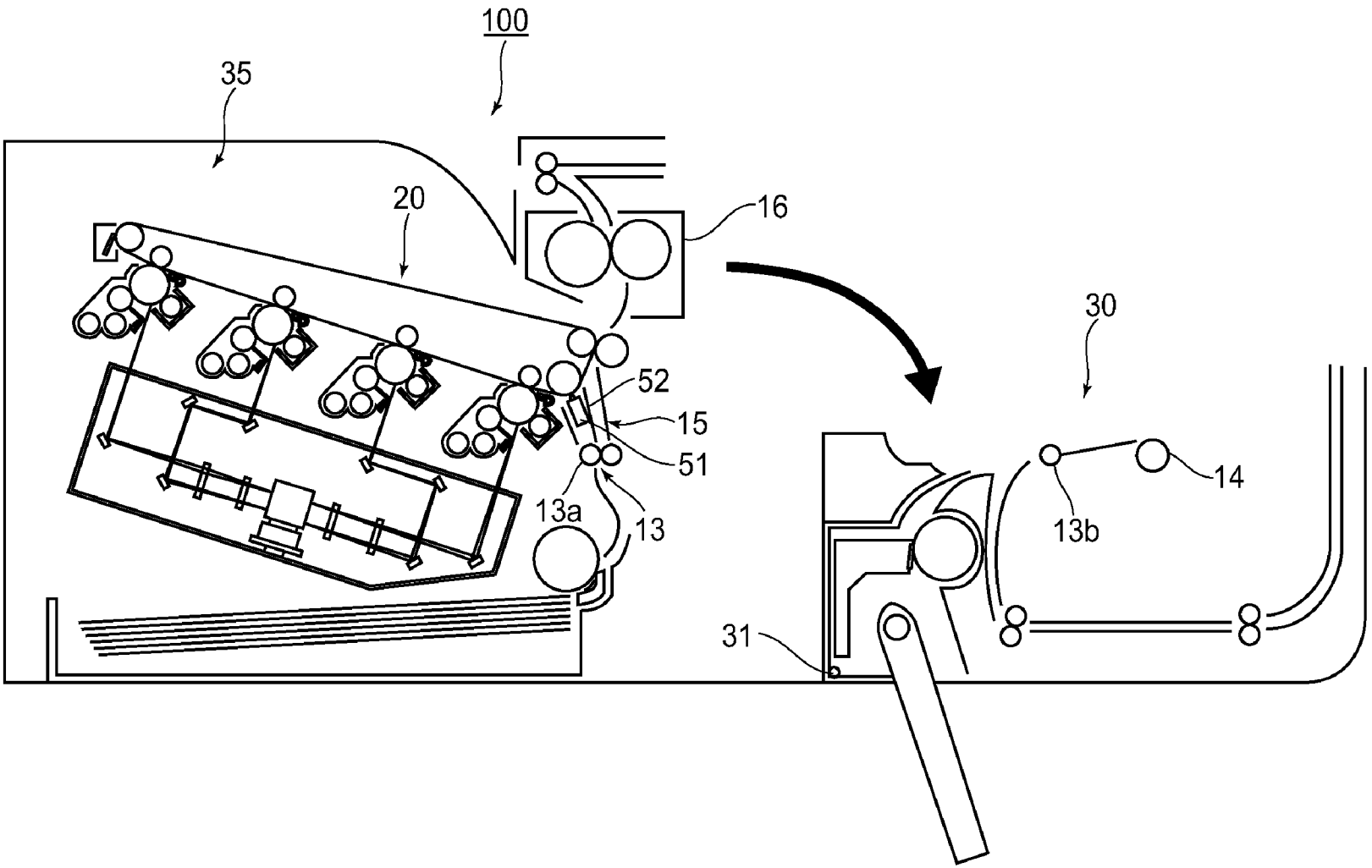
FIG. 3 is a schematic drawing of the image forming apparatus, shown in FIG. 1, the rotational movable portion of the housing of which is in the open position.
Figure 4:
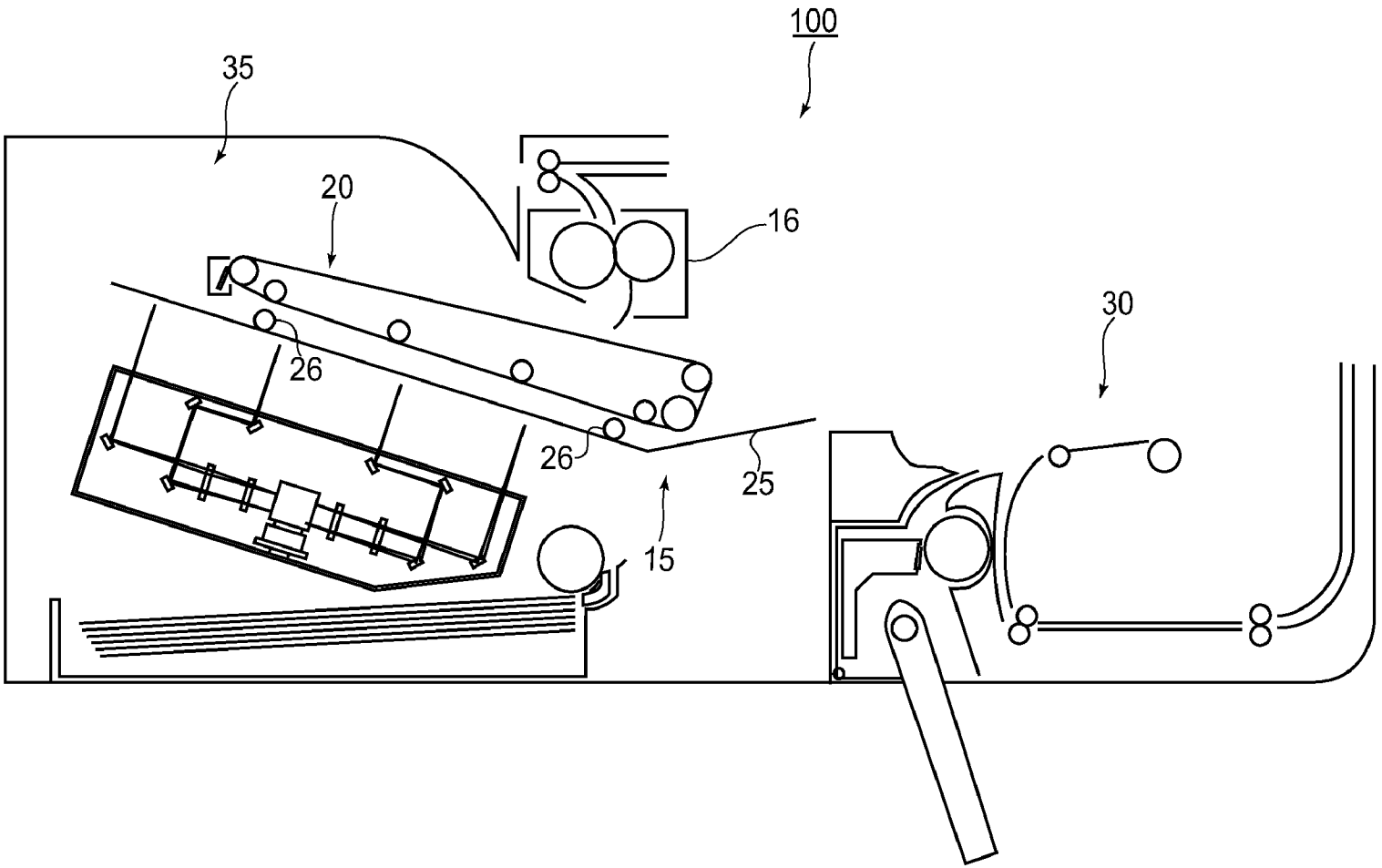
FIG. 4 is a schematic drawing of the image forming apparatus, showing the portion of the structural arrangement, which is for allowing the intermediary transfer unit to be pulled out of the main assembly of the image forming apparatus.
Figure 5:
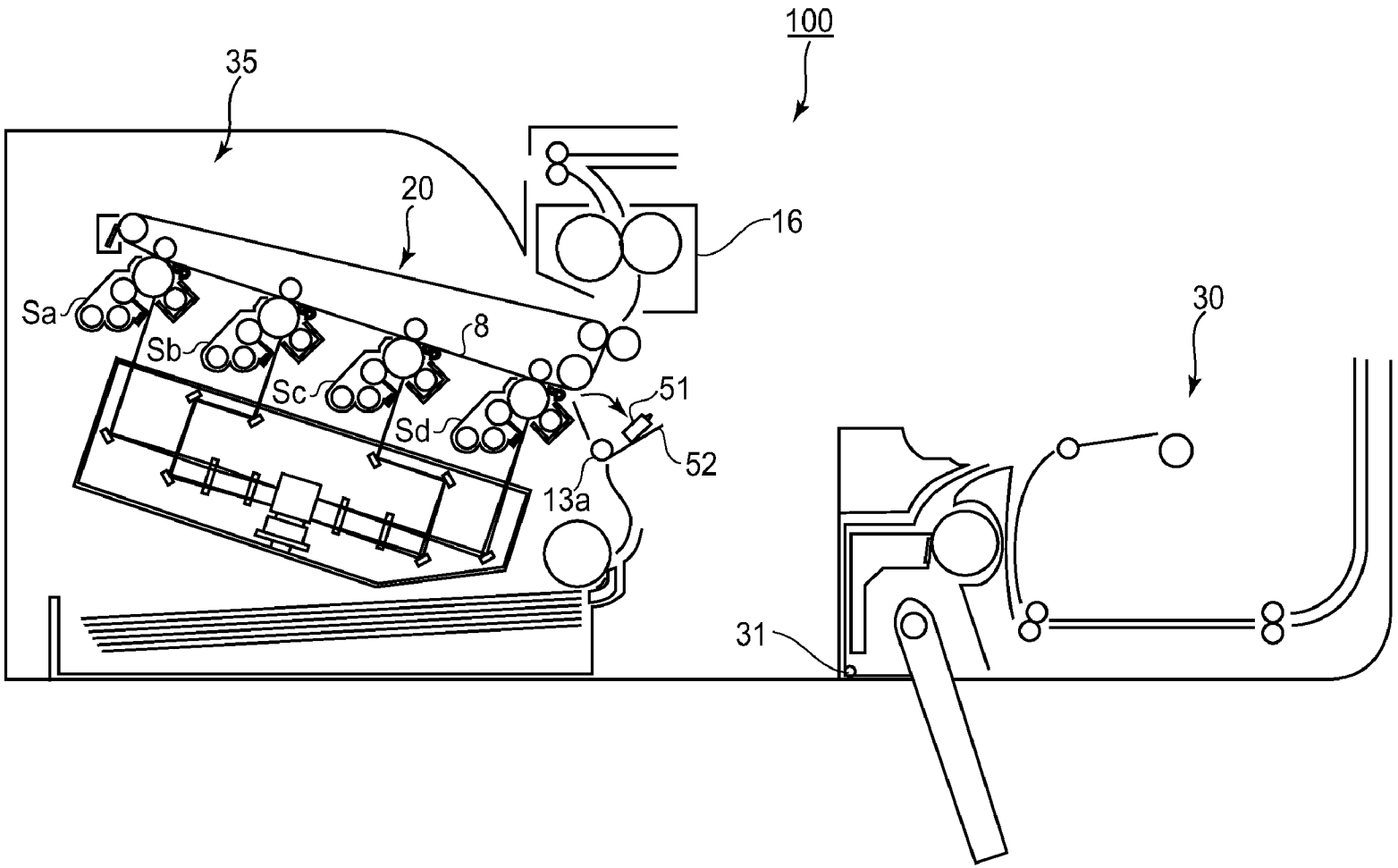
FIG. 5 is a schematic drawing of the image forming apparatus, showing the portion of the structural arrangement, which is for moving the optical member out of the intermediary transfer unit path.

FIG. 3 is a schematic drawing of the image forming apparatus 100, the rotationally movable portion (door unit) of which is fully open. FIG. 4 is an abbreviated schematic drawing of the image forming apparatus 100, which is for describing the structure for allowing the intermediary transfer unit to be pulled out of the main assembly of the image forming apparatus. FIG. 5 is a schematic drawing of the image forming apparatus 100, which is for describing the structure for moving the optical sensor out of the path of the intermediary transfer unit.

Referring to FIG. 3, the housing (casing) of the image forming apparatus 100 is made up of two portions 30 and 35, which are rotationally separable from each other along the recording medium conveyance passage (15) in order to create the opening through which the intermediary transfer unit (20) is pulled out of the main assembly of the apparatus 100. The portion 30 is the main portion which holds the image forming portions. The portion 35 is the portion rotatable movable about it axis, or the door unit. A guiding mechanism (25) is for guiding the intermediary transfer unit (20) diagonally downward so that the intermediary transfer unit (20) can be moved below the fixing apparatus (16) toward the opening without interfering with the fixing apparatus (16).

The image forming apparatus 100 is structured so that the right-hand portion 30 of the apparatus main assembly, which includes the registration rollers 13, recording medium conveyance passage 15, and secondary transfer portion T2, can be rotated rightward about the axial line 31 so that the registration roller 13*a*, recording medium conveyance passage 15, and secondary transfer portion T2 can be moved together away from the left-hand portion 31 of the apparatus main assembly.

The right-hand portion 30 of the apparatus main assembly holds a registration roller 13*b*, which is one of the pair of registration rollers 13, and the secondary transfer roller 14. Because of this structural arrangement, the image forming apparatus 100 is superior to an image forming apparatus in accordance with the art preceding the present invention, in terms of the efficiency with which a paper jam can be handled when it occurs at the pair of registration rollers 13, in the recording medium conveyance passage 15, and at the secondary transfer portion T2.

Referring to FIG. 4, the right-hand portion 30 of the apparatus main assembly of the image forming apparatus 100 is to be rotationally opened about the axis 31 to be separated from the left-hand portion of the apparatus main assembly along the recording medium conveyance passage 15, also when the intermediary transfer unit 20 needs to be taken out of the apparatus main assembly.

The left-hand portion 35 of the image forming apparatus 100 is provided with a pair of rails 25, that is, the front and rear rails, for guiding the rollers 26 attached to the intermediary transfer unit 20. The rails 25 are solidly fixed to the left-hand portion of the apparatus main assembly. When the intermediary transfer unit 20 is pulled out of the apparatus main assembly, it is pulled out, being supported and guided by the rails 25, through the abovementioned opening, which is created as the part of the recording medium conveyance passage 15 is moved away from the left-hand portion of the apparatus main assembly, by the clockwise rotational movement of the right-hand portion of the apparatus main assembly, about its rotational axis.

In order to prevent the intermediary transfer unit 20 from coming into contact with the right-hand portion 30 while it is moved below the fixing apparatus 16, which is fixedly positioned in the top portion of the left-hand portion 35 of the apparatus housing, the rails 25 are bent in such a manner that the portion of each rail 25, which roughly corresponds in position to the bottom portion of the belt loop when the intermediary transfer unit 20 is in its image transfer position, gradually descends toward the driver roller 58, and the portion extending rightward from the downwardly tilted portion is tilted slightly upward.

CONCRETE DESCRIPTION OF PRESENT INVENTION

Referring to FIG. 1, in the case of the image forming apparatus 100 in this embodiment, its intermediary transfer belt (8) is disposed above the multiple image bearing members. The primary transferring means (5*d*), that is, one of the multiple primary transferring means of the apparatus 100, transfers (primary transfer) the toner image on the image bearing member 1*d*. The image forming means 3*d*, that is, one of the multiple exposing means, writes an electrostatic image on the image bearing member (1*d*), that is, one of the multiple image bearing members, and the image forming means 4*d*, that is, one of the multiple developing means, develops the electrostatic image on the image bearing member, into a toner image.

The belt supporting downstream member (58) supports and tensions the intermediary transfer belt (8), at the downstream end of the bottom portion of the belt loop, in terms of the moving direction of the intermediary transfer belt (8). The intermediary transfer unit (20) includes at least the intermediary transfer belt (8) and belt supporting downstream member (58). The secondary transfer portion (T2) transfers (secondary transfer) the toner image on the intermediary transfer belt (8) onto a recording medium. The recording medium conveyance passage (15) conveys a recording medium upward from the secondary transfer portion (T2). The fixing means (16) is above the secondary transfer portion (T2). It fixes the toner image(s) to a recording medium after the toner image(s) are transferred (secondary transfer) onto the recording medium.

The detecting member (51) detects the density level and position of a toner image formed on the intermediary transfer belt (8). The image adjusting means (100) adjusts the image forming means, based on the results of the toner image detection by the detecting means (51).

The housing (made up of right- and left-hand portions 30 and 35) houses the intermediary transfer unit (20), detecting means (51), and recording medium conveyance passage (15). It can be rotationally moved to be opened to create the opening along the recording medium conveyance passage 15. The guiding mechanism (25) guides the intermediary transfer unit (20) to make it easier for the intermediary transfer unit (20) to be moved out of the main assembly of the image forming apparatus 100 through the above-mentioned opening.

The detecting member (51) is positioned in an area where it faces the portion of the intermediary transfer belt loop, which is on the downstream side of the belt supporting downstream member (58) and on the upstream side of the secondary transfer portion (T2), in terms of the moving direction of the intermediary transfer belt (8). The detecting member moving mechanism (54) moves the detecting member (51) away from the intermediary transfer unit (20) in coordination with the movement of the intermediary transfer unit (20) through the opening. More specifically, the detecting member moving member (54) rotationally moves the detecting member (51) about the rotational axis of the member (54), which is parallel to the belt supporting downstream member (58).

The detecting member (51) detects the control toner image on the intermediary transfer belt (8) when the portion of the intermediary transfer belt (8), across which the control toner image is borne, curves upward following the curvature of the peripheral surface of the belt supporting downstream member (58). The detecting member moving mechanism (54) has a detecting member positioning member (54), which positions the detecting member (51) relative to the belt supporting downstream member (58) by being in contact with the portion of the intermediary transfer belt (8), which is in contact with the peripheral surface of the belt supporting downstream member (58) (which is moving through the portion of the belt loop, which curves upward following the peripheral surface of the belt supporting downstream member (58).

The intermediary transfer unit (20) includes the backup roller (22), which is located above the belt supporting downstream member (58), and forms the secondary transfer portion (T2) by supporting the intermediary transfer belt (8) from within the belt loop. The belt supporting downstream member (58) is the driver roller which circularly drives the intermediary transfer belt (8).

The detecting member moving mechanism (54) has a recording medium guiding surface (52), which makes up one of the recording medium guiding surfaces of the recording medium conveyance passage (15). The detecting member moving mechanism (54) is provided with a recording medium conveying rotatable member (13*a*), which is located below the belt supporting downstream member (58) to convey a recording medium to the secondary transfer portion (T2). The rotational axis of the detecting member moving mechanism (54) coincides with the rotational axis of the recording medium conveying rotatable member (13*a*).

The intermediary transfer unit (20) includes the belt supporting upstream member (21), which supports the intermediary transfer belt (8) from the inward side of the belt loop, at the opposite end of the belt loop from the belt supporting downstream member (58). Thus, the belt supporting upstream member (21) and belt supporting downstream member (58) separate the belt loop into the top portion, and the bottom portion across which the intermediary transfer belt (8) contacts the multiple image bearing members. The intermediary transfer unit (20) is structured so that the belt supporting upstream member (21) is positioned higher than the belt supporting downstream member (58), shaping thereby the belt loop in such a manner that the bottom portion of the belt loop gradually descends toward the belt supporting downstream member (58). The fixing means (16) is fixedly positioned lower than the belt supporting upstream member (21). The guiding mechanism (25) guides the intermediary transfer unit (20) to the opening in such a manner that the intermediary transfer unit (20) passes below the fixing means (16), when the intermediary transfer unit (20) is moved out of the apparatus main assembly of the image forming apparatus 100.

<Detecting Member Retracting Mechanism>

Figure 6:
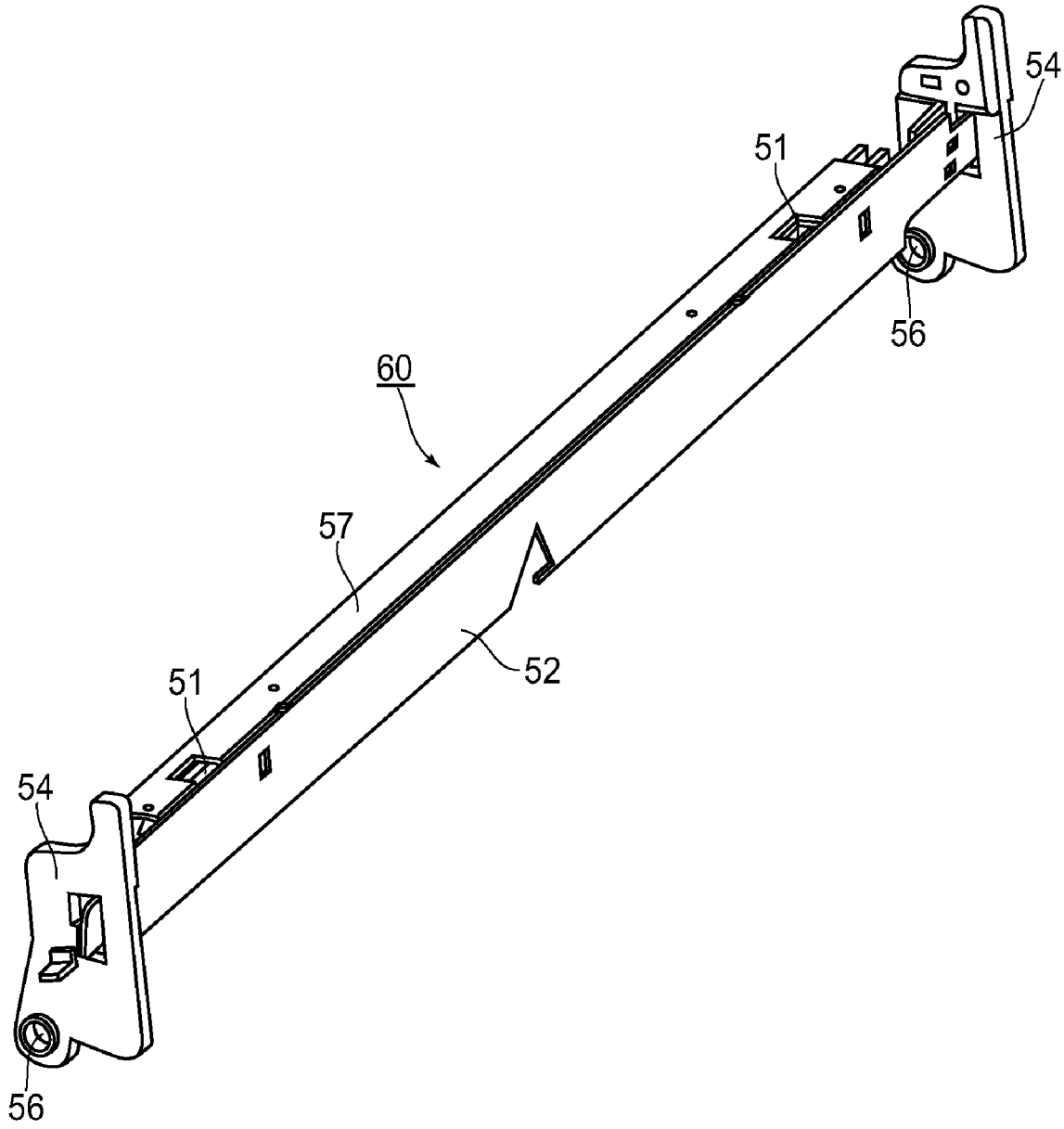
FIG. 6 is a perspective view of the pre-transfer density level detection unit (unit for detecting density level of control toner image before toner image transfer onto recording medium).
Figure 7:
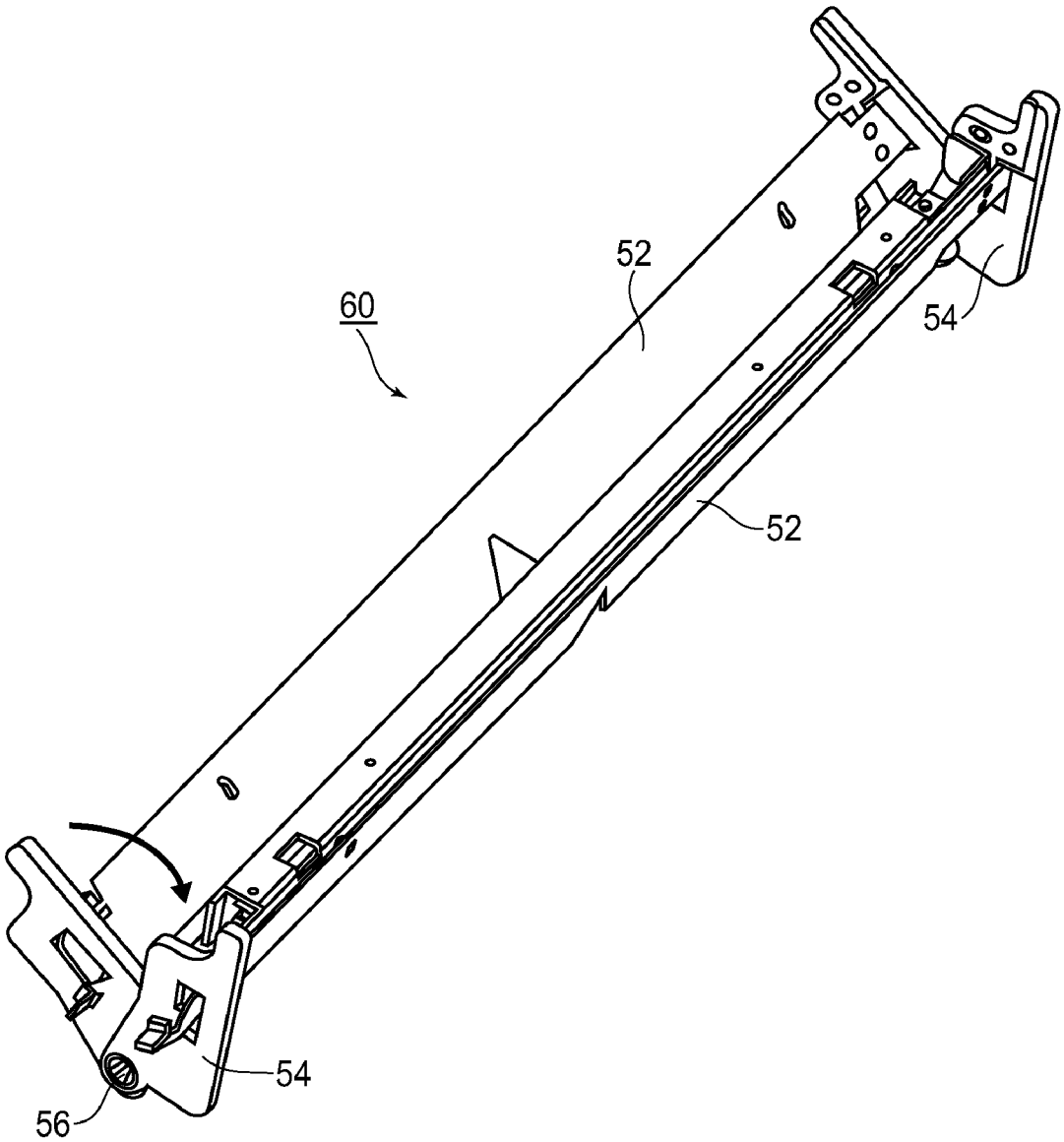
FIG. 7 is a perspective view of the pre-transfer density detection unit, showing how the unit is rotated.
Figure 8:
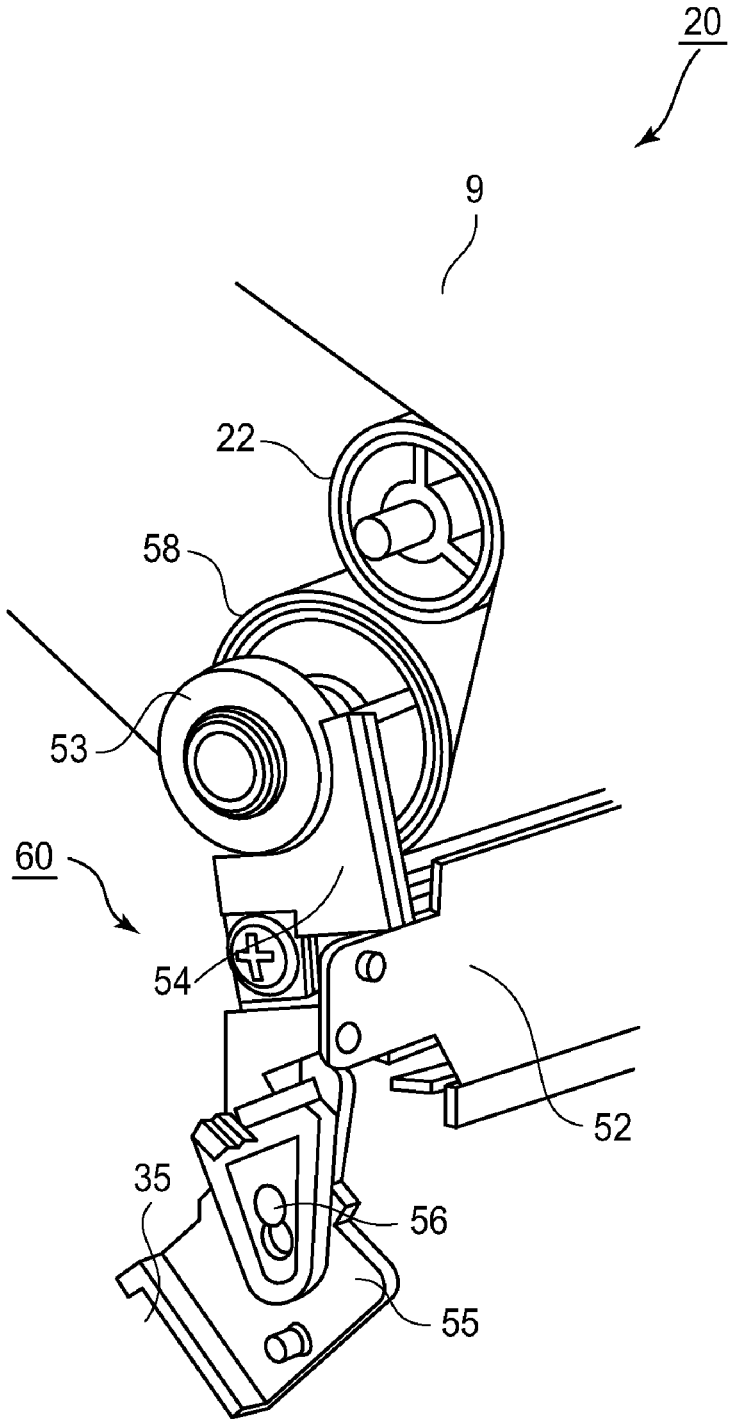
FIG. 8 is a perspective view of one of the lengthwise end portions of the intermediary transfer unit, showing the structure of the portion.

FIG. 6 is a perspective view of the pre-transfer toner image density level detecting unit. FIG. 7 is a perspective view of the pre-transfer toner image density level detecting unit, which is being rotated. FIG. 8 is a schematic drawing of one of the lengthwise end portions of the intermediary transfer unit (20), and shows the structure of the lengthwise end portion.

Referring to FIG. 2, the detecting member moving mechanism (54) moves the detecting member (51) out of the path through which the intermediary transfer unit (20) is to be pulled out, by rotationally moving the detecting member (51) about the rotational axis of the detecting member (51), which is parallel to the rotational axis of the belt supporting downstream member (58), in coordination with the operation for pulling the intermediary transfer unit (20) out of the apparatus main assembly.

The detecting member (51) faces the intermediary transfer belt (8), in the area where the belt loop curves upward, following the peripheral surface of the belt supporting downstream member (58). The detecting member positioning member (54) precisely positions the detecting member (51) relative to the belt supporting downstream member (58) by coming into contact with at least two points of the peripheral surface of the bearing 53 of the belt supporting downstream member (58), which is coaxial with the belt supporting downstream member (58).

Therefore, the combination of the detecting member moving mechanism (54) and bearing (53) positions the detecting member (51) a preset distance away from the belt supporting downstream member (58). Therefore, it is ensured that the positional relationship between the detecting member (51) and intermediary transfer unit (20) after the intermediary transfer unit (20) is remounted into the apparatus main assembly is exactly the same as that before the intermediary transfer unit (20) was pulled out of the apparatus main assembly. The positional relationship between the detecting member (51) and intermediary transfer belt (8) includes both the distance between the two members (51) and (8), and the angle between the direction in which the detecting member (51) is aimed and the line tangential to the arcuate portion of the belt loop, at the focal point of the beam of detection on the portion of the intermediary transfer belt (8), which corresponds in position to the arcuate portion of the belt loop.

The backup roller (22) is located above the belt supporting downstream member (58), and supports the intermediary transfer belt (8) from the inward side of the belt loop, forming the secondary transfer portion (T2). The belt supporting downstream member (58) is a driver roller which circularly drives the intermediary transfer belt (8).

The detecting member moving mechanism (54) has a recording medium guiding surface (52), which makes up one of the recording medium guiding surfaces of the recording medium conveyance passage (15). The detecting member moving mechanism (54) is provided with a recording medium conveying rotatable member (13*a*), which is located below the belt supporting downstream member (58) to convey a recording medium to the secondary transfer portion (T2). The rotational axis of the detecting member moving mechanism (54) coincides with the rotational axis of the recording medium conveying rotatable member (13*a*).

Therefore, even when the detecting member (51) is rotationally moved, the distance between the recording medium conveying rotatable member (13*a*) and recording medium guiding surface (52) does not change. Therefore, even if the recording medium guiding surface (52) is extended very close to the recording medium conveying rotatable member (13*a*), the recording medium guiding surface (52) does not come into contact with the recording medium conveying rotatable member (13*a*) when the detecting member (51) is rotationally moved.

It is for the two reasons described above that the optical sensor 51 is positioned in the abovementioned area where the belt loop curves upward, following the peripheral surface of the belt supporting downstream member (58).

Referring to FIG. 2, because of the above described structural arrangement, the optical sensor 51 is in the zone DZ through which the intermediary transfer unit 20 is pulled out of the apparatus main assembly. Therefore, if the optical sensor 51 is fixed in position as the optical sensor of a conventional detecting member is, the intermediary transfer unit 20 cannot be pulled out of the apparatus main assembly.

Obviously, it is possible to attach the optical sensor 51 so that it can be moved out of the zone (path) of the intermediary transfer unit 20. However, if the optical sensor 51 is attached so that the multiple steps have to be taken to remove or remount the optical sensor 51, the intermediary transfer unit 20 cannot easily mounted or dismounted.

It is also in the zone (path) DZ which the intermediary transfer unit 20 occupies when the intermediary transfer unit 20 is pulled out of the apparatus main assembly in the direction indicated by an arrow mark R5 that the guide 52 for guiding a recording medium to the secondary transfer portion T2 is located. Therefore, in the case of an image forming apparatus structured so that its guide 52 cannot be shifted in position as the optical sensor 51 cannot as described above, the intermediary transfer unit 20 cannot be pulled out of the apparatus main assembly.

Thus, the guide 52 and optical sensor 51 of the image forming apparatus 100 are attached to the positioning member 54, which is rotationally movable, so that the guide 52 and optical sensor 51 can be moved out of the zone (path) DZ of the intermediary transfer unit 20 by rotationally moving the positioning member 54. When it is necessary to move the intermediary transfer unit 20 out of the apparatus main assembly, the positioning member 54 is pivotally moved, along with the guide 52 and optical sensor 51, to a position outlined by broken lines in the drawing. This pivotal movement of the positioning member 54 moves the guide 52 and optical sensor 51 out of the zone (path) DZ of the intermediary transfer unit 20, preventing the guide 52 and optical sensor 51 from interfering with (coming into contact with) the intermediary transfer unit 20 when the intermediary transfer unit 20 is pulled out of the apparatus main assembly. Since they do not come into contact with the intermediary transfer unit 20, the problem that they are impacted by the intermediary transfer unit 20 as they come into contact with the intermediary transfer unit 20, does not occur.

Referring to FIG. 5, the optical sensor 51 and guide 52 are attached to the positioning member 54, the rotational axis of which coincides with the rotational axis of the registration roller 13*a*. Thus, as the positioning member 54 is rotationally moved, the optical sensor 51 and guide 52 also are rotationally moved about the axial line of the registration roller 13*a* (axial line of positioning member 54). As the intermediary transfer unit 20 is pulled out rightward from the apparatus main assembly, the positioning member 54 is pivotally moved about its rotational axis (rotational axis of registration roller 13*a*), in a manner to fall down toward the right-hand portion 30 of the image forming apparatus 100. Therefore, the optical sensor 51 and guide 52 are automatically moved out of the zone (path) DZ of the intermediary transfer unit 20.

Referring to FIG. 6 as well as FIG. 2, the guide 52 is formed of metallic plate. The plate 57 to which the optical sensor 51 is attached is attached to the guide 52. The optical sensor 51 is attached to the surface of the plate 57, which faces downward after the assembly of the image forming apparatus 100.

Next, referring to FIG. 7 as well as FIG. 2, the lengthwise ends of the guide 52 are connected to the positioning members 54, one for one, which are rotationally movable about a supporting portion 56. The cross section of the supporting portion 56 is in the form of an elongated circle. Therefore, the optical sensor 51 can be adjusted in its distance from the intermediary transfer belt 8.

The guide 52, optical sensor 51, and positioning member 54 are integrally assembled, making up a pre-transfer density level detection unit 60.

Integrating the guide 52, optical sensor 51, and positioning member 54 as the pre-transfer density level detection unit 60, makes it possible for the guide 52 and optical sensor 51, which used to be individually positioned relative to the intermediary transfer unit 20, to be precisely positioned relative to the intermediary transfer unit 20 through a single operation. That is, the pair of optical sensors 51, that is, the optical sensor located on the front side of the image forming apparatus 100, and the optical sensor 51 located on the rear side of the image forming apparatus 100, can be positioned at the same level, and also, at the same angle in terms of the rotational direction of the intermediary transfer belt 8.

Next, referring to FIG. 8 as well as FIG. 2, the positioning member 54 of the pre-transfer density level detection unit 60 doubles as the member for precisely positioning the detecting member 51 relative to the intermediary transfer unit 20.

The pre-transfer density level detection unit 60 is supported so that it can be rotationally moved relative to the pre-transfer density level detection unit placement board 55, about the supporting portion 56 attached to the positioning member 54 Rotationally moving the pre-transfer density level detection unit 60 roughly 60 degrees about the axial line of the registration roller 13*a* moves the pre-transfer density level detection unit 60 out of the zone (path) DZ through which the intermediary transfer unit 20 is moved out of the apparatus main assembly.

Figure 12:
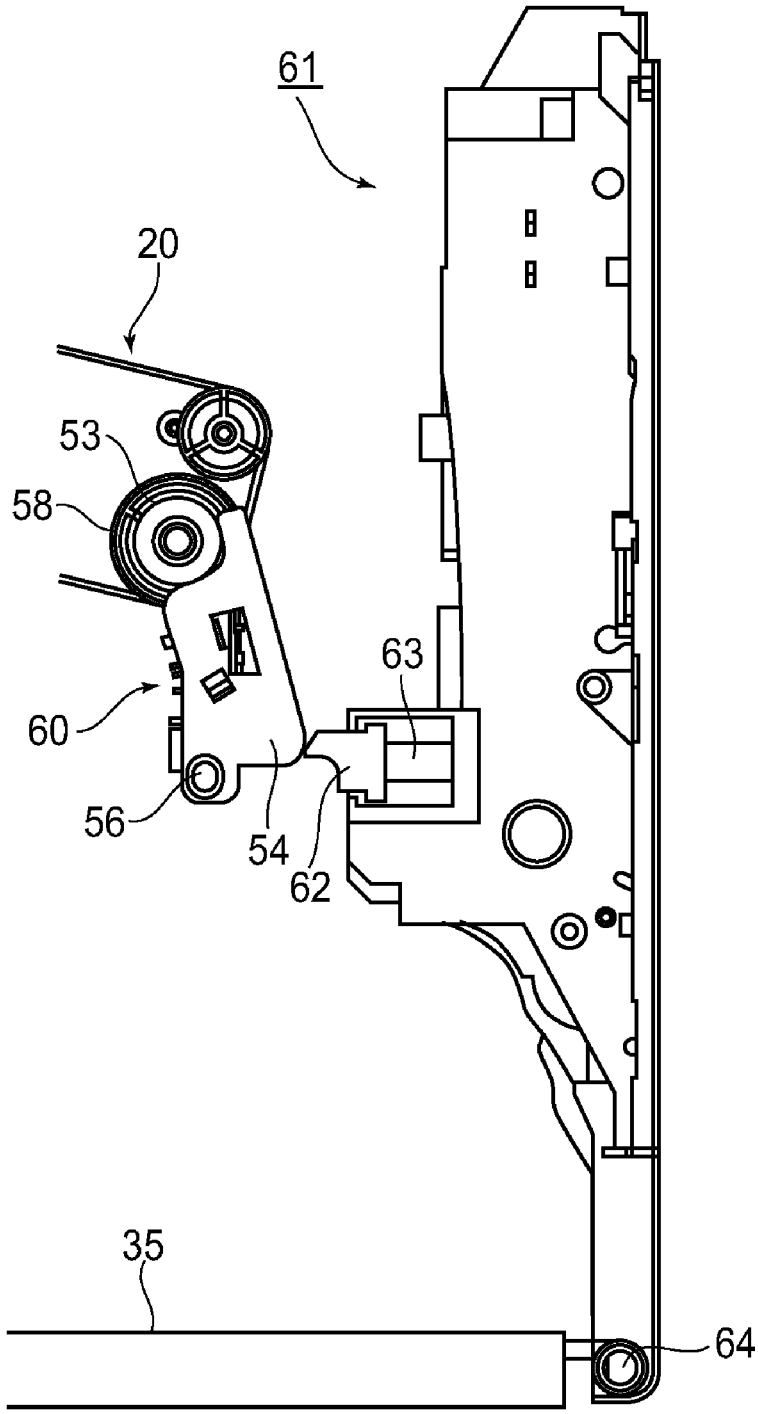
FIG. 12 is a schematic drawing of the closed right door unit.

The driver roller 58 of the intermediary transfer unit 20 is supported by a pair of bearings 53; the lengthwise end portions of the shaft of the driver roller 58 are supported by the pair of bearings 53, one for one. The pair of positioning members 54, which are located at the lengthwise ends of the pre-transfer density level detection unit 60, one for one, are provided with an inwardly curved edge (FIG. 12). At least two points of this curved edge contact the peripheral surface of the bearing 53. Therefore, the two optical sensors 51 are always placed at the same level, and also, at the same angle in terms of the rotationally moving direction of the intermediary transfer belt 8.

Further, in order to keeps the pre-transfer density level detection unit 60 pressed upon the driver roller 58, the positioning member 54 is provided with an unshown pre-transfer density level detection unit detaining mechanism. The detaining mechanism is designed so that it presses the positioning member 54 toward, or away from, the driver roller 58, depending on which side of the mid point of the rotational movement range of the positioning member 54 the positioning member 54 is. Therefore, as the intermediary transfer unit 20 is mounted into the apparatus main assembly, the positioning member 54 is lifted by a distance which falls within the play with which the supporting portion 56 is provided, while remaining pressed by the detaining mechanism. Therefore, it is ensured that the positioning member 54 is pressed upon the bearing 53. Therefore, it is ensured that at least two points of the positioning member 54 come into contact with the bearing 53. Therefore, as the intermediary transfer unit 20 is remounted into the apparatus main assembly, the optical sensor 51 is placed in the exactly the same position as it was before the intermediary transfer unit 20 was moved out of the apparatus main assembly.

Referring to FIG. 5, in the case of the image forming apparatus 100, when the intermediary transfer unit 20 is moved out of the apparatus main assembly, the pre-transfer density level detection unit 60 is automatically moved out of the path of the intermediary transfer unit 20, making it easier for the intermediary transfer unit 20 to be moved out of the image forming apparatus 100.

Also in the case of the image forming apparatus 100, the outward movement of the intermediary transfer unit 20 automatically moves the pre-transfer density level detection unit 60 out of the path of the intermediary transfer unit 20. Therefore, it is smaller in the number of steps which have to be taken to move the intermediary transfer unit 20 out of the image forming apparatus 100 than an image forming apparatus in accordance with the conventional art. More concretely speaking, in the case of the image forming apparatus 100, neither the step for retracting the guide 52, nor the step for retracting the optical sensor 51, is necessary.

Further, all that is necessary to precisely position the guide 52 and optical sensor 51 when the intermediary transfer unit 20 is remounted into the image forming apparatus 100 is to raise the positioning member 54 from the position into which it was retracted, and flip it toward the intermediary transfer unit 20. To describe more concretely, as the positioning member 54 is flipped toward the intermediary transfer unit 20, it is pressed toward the intermediary transfer unit 20 by the detaining mechanism. As a result, the abovementioned concavely arcuate edge of the positioning member 54 is pressed upon the bearing 53, precisely positioning the guide 52 and optical sensor 51 relative to the portion of the intermediary transfer belt 8, which is supported by the driver roller 58.

In other words, the employment of the above described structural arrangement can reduce in size an image forming apparatus without increasing the number of steps for removing the intermediary transfer unit 20 from the image forming apparatus 100, or remounting the intermediary transfer unit 20 into the image forming apparatus 100.

That is, the present invention can simplify the mechanism for positioning the optical sensor 51 and guide 52. Therefore, it can provide an image forming apparatus which is significantly less expensive, and smaller, than an image forming apparatus in accordance with the art prior to the present invention.

In the case of the image forming apparatus 100, the intermediary transfer unit 20 is not removed through the opening of the top wall of the image forming apparatus 100. That is, the top wall of the image forming apparatus 100 does not need to be provided with the opening through which the intermediary transfer unit 20 is removed from, or remounted into, the image forming apparatus 100. Therefore, such devices as an image reading apparatus, and/or electrical circuit, etc., can be placed above the intermediary transfer unit 20, affording therefore more latitude in apparatus design.

Further, when the intermediary transfer unit 20 is horizontally pulled out of, or remounted into, the image forming apparatus 100, the weight of the intermediary transfer unit 20 is supported by the rails 25. Therefore, the intermediary transfer unit 20 can be more easily removed or remounted than the intermediary transfer unit of an image forming apparatus in accordance with the art prior to the present invention. That is, not only can the intermediary transfer unit 20 be easily removed or remounted by a single person, but also, can be precisely positioned by a single person, even if the intermediary transfer unit 20 is rather heavy.

Embodiment 2

Figure 9:
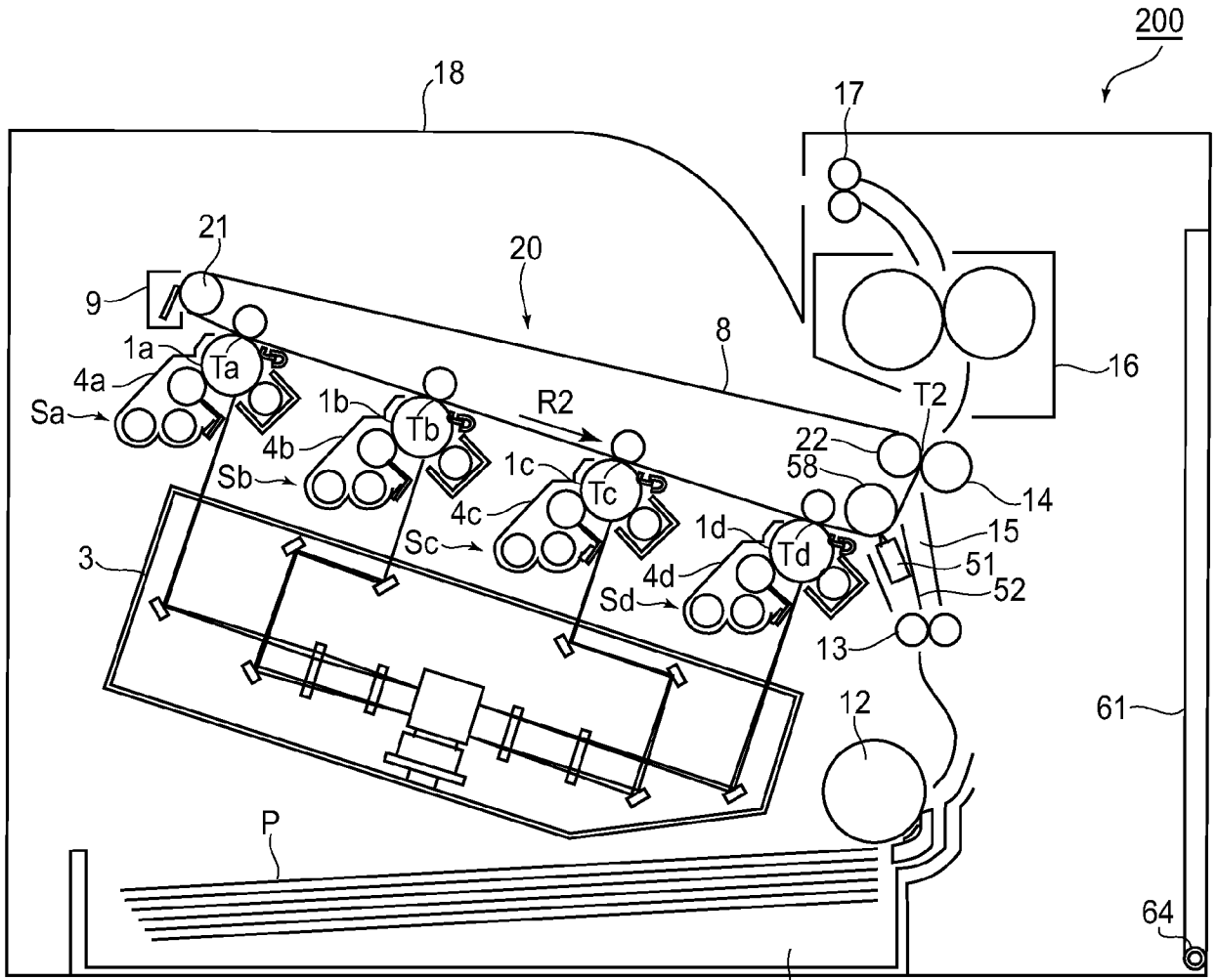
FIG. 9 is a schematic drawing of the image forming apparatus in the second preferred embodiment of the present invention.
Figure 10:
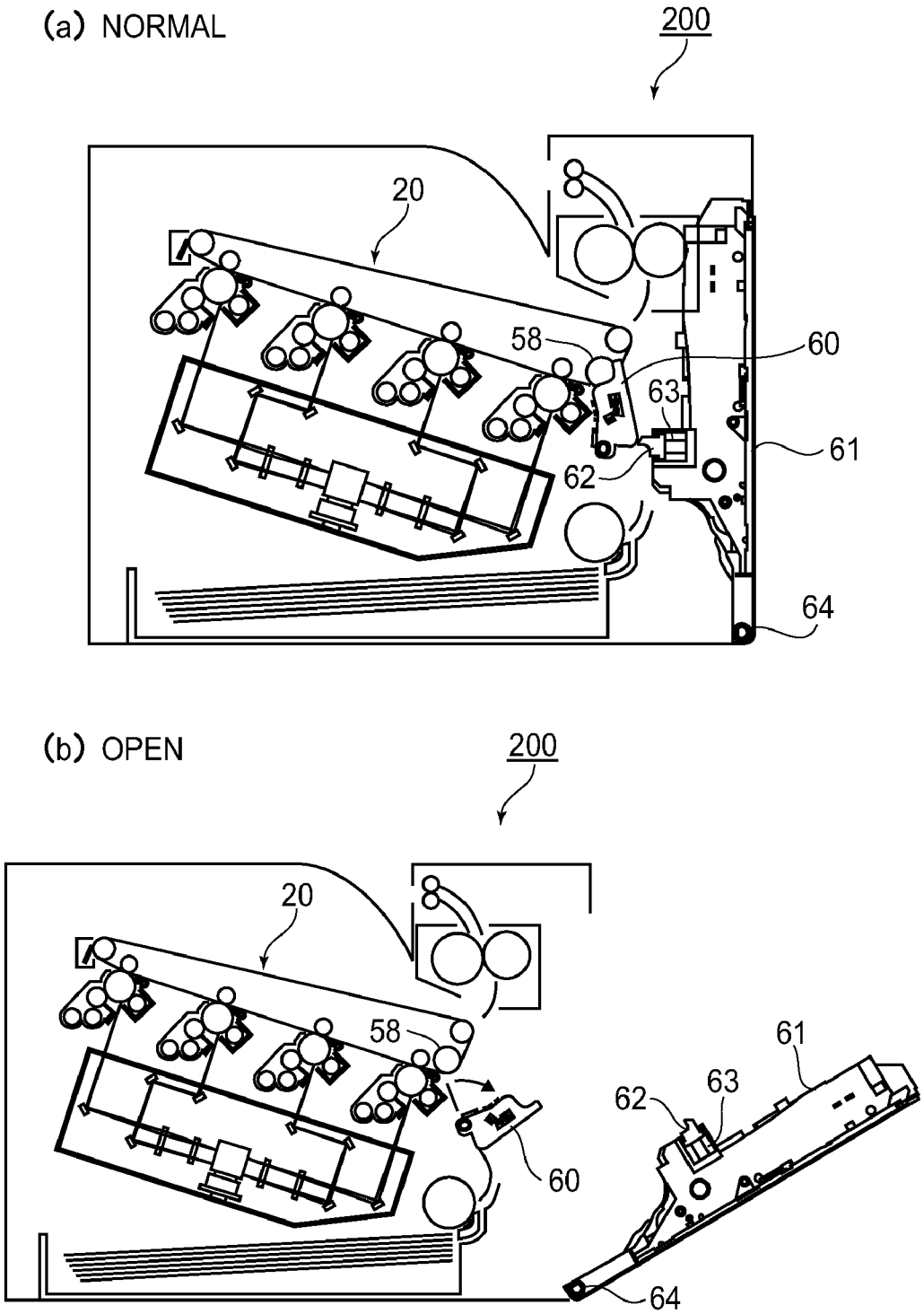
FIG. 10(*a*) is a schematic drawing of the image forming apparatus in the second preferred embodiment, which is in the normal state, and FIG. 10(*b*) is a schematic drawing of the image forming apparatus, which is open to allow the intermediary transfer unit to be pulled out of the main assembly of the apparatus.
Figure 11:
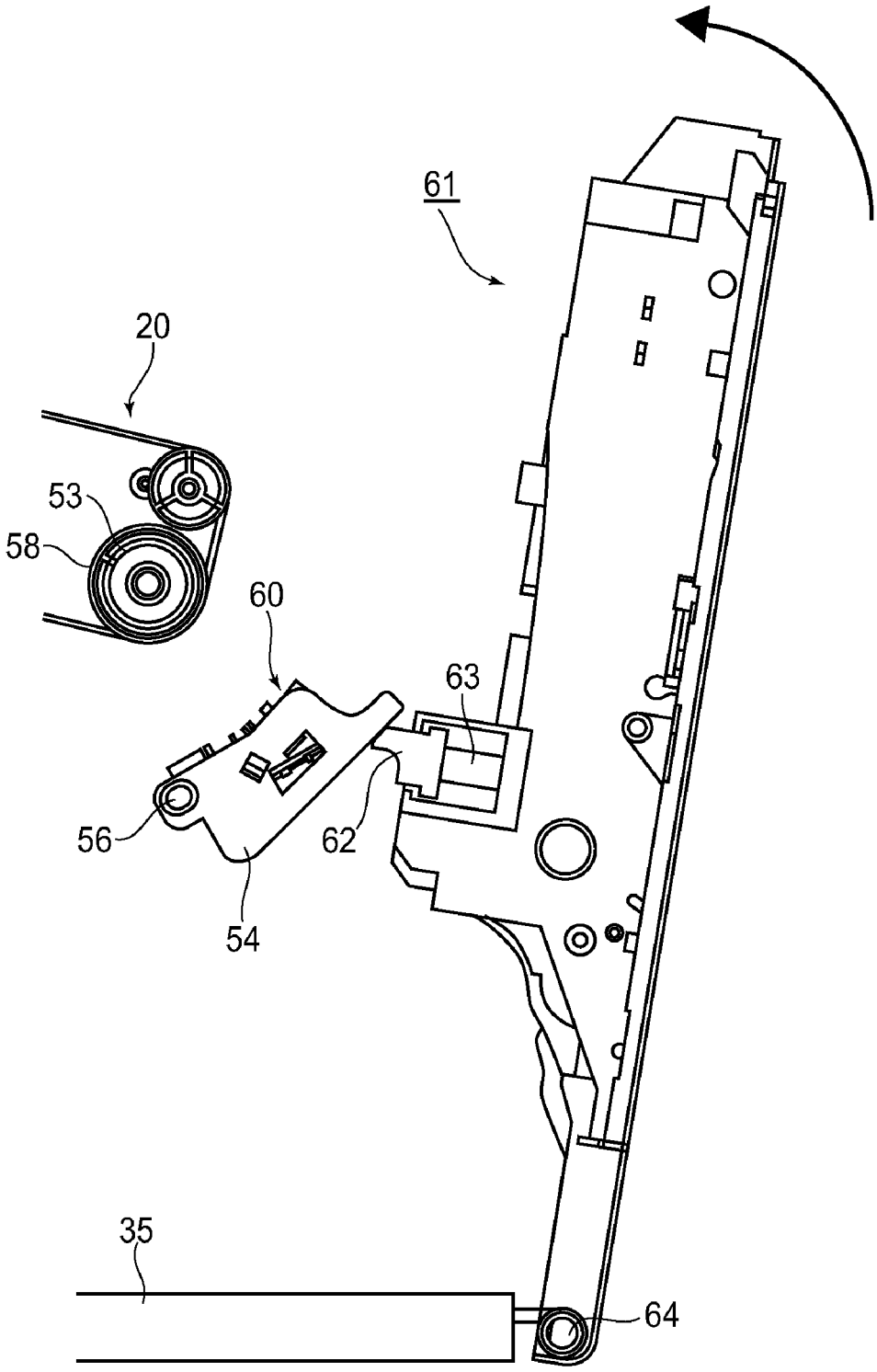
FIG. 11 is a schematic drawing of the right door unit, which is being closed.

FIG. 9 is a schematic drawing of the image forming apparatus in the second preferred embodiment of the present invention, and shows the structure of the apparatus. FIG. 10(*a*) is a schematic drawing of the same image forming apparatus as the one shown in FIG. 9, which is in the normal condition, and FIG. 10(*b*) is a schematic drawing of the same image forming apparatus as the one shown in FIG. 9, the door unit of which is open. FIG. 11 is a drawing of the right-hand door unit, which is being closed. FIG. 12 is a drawing of the closed right-hand door unit.

The image forming apparatus 200 in this embodiment is provided with a restore mechanism, and a door unit 61, which replaced the right-hand portion 30 of the image forming apparatus 100 in the first embodiment. Thus, the optical sensor 51 is moved into a preset position by the closing movement of the door unit 61. Otherwise, the structure of the image forming apparatus 200 is the same as that of the image forming apparatus 100 in the first embodiment. Thus, the structural components, features, etc., shown in FIGS. 9-12, which are the same as the counterparts of the image forming apparatus 100, are given the same referential codes, one for one, as those given to the counterparts shown in FIGS. 1-8, and will not be described to avoid repeating the same descriptions.

Referring to FIG. 9, in the case of this image forming apparatus 200, rotationally moving the door unit 61 about its rotational axis in the clockwise direction makes it possible for the intermediary transfer unit 20 to be pulled out of the image forming apparatus 200 (FIG. 4). As the door unit 61 is opened as described above, the guide 52 and optical sensor 51 rotate together in the direction to move out of the path of the intermediary transfer unit 20. Therefore, they do not interfere with the outward movement of the intermediary transfer unit 20 (FIG. 2).

<Restore Mechanism>

Referring to FIG. 10(*a*), the restore mechanism (62) causes the opened door unit (61) to rotate in the opposite direction from the direction in which the door unit (61) was opened, at the same time as the door unit (61) is rejoined with the right-hand portion of the apparatus main assembly, along the recording medium conveyance passage (15), in order to return the detecting member (51) to the abovementioned preset position (detection position) in which the detecting member (51) was before the door unit (61) was opened.

As the opened door unit (61) of the image forming apparatus 200 is rotationally moved about its rotational axis in the counterclockwise direction into its upright position, the pressing member 62 comes into contact with the retracted pre-transfer density level detection unit 60, and rotationally moves the pre-transfer density level detection unit 60 in the counterclockwise direction so that the pre-transfer density level detection unit 60 tilts toward the driver roller 58 to be precisely positioned.

Next, referring to FIG. 10(*b*), rotationally moving the door unit 61 of the image forming apparatus 200 in the clockwise direction into its open position causes the pressing member 62 to release the pre-transfer density level detection unit 60, allowing thereby the pre-transfer density level detection unit 60 to rotate in the clockwise direction to move out of the path of the intermediary transfer unit 20.

When the intermediary transfer unit 20 is moved out of the image forming apparatus 200 after the opening of the door unit 61, the pre-transfer density level detection unit 60 is pushed by the intermediary transfer unit 20, being thereby rotationally moved in the clockwise direction; it is tilted rightward of the drawing.

Incidentally, the movement of the pre-transfer density level detection unit 60 out of the path of the intermediary transfer unit automatically ends as it is tilted rightward by a preset angle while the intermediary transfer unit 20 is moved out of the image forming apparatus 200, as stated in the description of the first preferred embodiment. However, if necessary, for example, when it is necessary to examine or clean the intermediary transfer belt 8 while keeping the intermediary transfer unit 20 in the image forming apparatus 200, the pre-transfer density level detection unit 60 may be manually tilted rightward into its retreat.

Referring to FIG. 11, while the door unit 61 is closed, the pressing member 62 of the door unit 61 pulls the pre-transfer density level detection unit 60 out of its retreat, and rotates the pre-transfer density level detection unit 60 back into the position in which the pre-transfer density level detection unit 60 was before it was moved into the retreat shown in FIG. 12.

The door unit 61 is designed to be rotationally movable about its rotational axle 64 attached to the bottom wall of the left-hand portion of the apparatus main assembly. The door unit 61 is provided with a pair of pressing members 62 for lifting the pre-transfer density level detection unit 60 to the preset position. The pressing members 62 are located at the front and rear ends of the door unit 61, facing the pair of positioning members 54 of the pre-transfer density level detection unit 60, one for one. A pressing spring 63 presses the pressing member 62 to ensure that the positioning member 62 of the door unit 61 is placed in contact with the bearing 53. There are two pressing springs 63, which are located at the front and rear ends of the door unit 61, one for one, so that they press the pressing members 62, one for one.

Referring to FIG. 12, while the door unit 61 is rotationally moved in the counterclockwise direction to be positioned upright, the pressing member 62 comes into contact with the straight portion of the positioning member 54, and rotates the pre-transfer density level detection unit 60 in the counterclockwise direction as it slides on the straight portion. Then, just before the door unit 61 is completely closed, the positioning member 54, which is under the pressure from the pressing member 62, comes into contact with the bearing 53 and is pressed upon the bearing 53 by the pressure from the pressing spring 63, positioning the pre-transfer density level detection unit 60 relative to the driver roller 58.

Referring to FIG. 1, the image forming apparatus 100 is structured so that after the intermediary transfer unit 20 is properly mounted into the main assembly of the image forming apparatus 100, the positional relationship between the intermediary transfer unit 20 and each of the image forming portions Sa, Sb, Sc, and Sd does not change. Thus, it does not occur that the intermediary transfer unit 20 shifts upward.

Referring to FIG. 12, therefore, while the positioning member 54 remains pressed upon the bearing 53, the compression spring 63 remains compressed, providing therefore the positioning member 54 with the pressure by which it is kept pressed upon the bearing 53. Therefore, not only does closing the door unit 61 (optical sensor 51 in FIG. 9) into its upright position place the intermediary transfer unit 20 back into the position in which it was before the intermediary transfer unit 20 was pulled out of the image forming apparatus 200, but also, keep the pre-transfer density level detection unit 60 precisely positioned relative to the driver roller 58.

The pre-transfer density level detection unit 60 of the image forming apparatus 200 is automatically tilted rightward by the outward movement of the intermediary transfer unit 20, when the intermediary transfer unit 20 is pulled out of the image forming apparatus 200. Further, as the door unit 61 is closed, the intermediary transfer unit 20 is automatically put back into the preset position, in which it was before the intermediary transfer unit 20 was pulled out.

Therefore, the operation for replacing the intermediary transfer unit 20 in the image forming apparatus 200 in the second preferred embodiment is smaller in the number of steps, compared to even the operation for replacing the intermediary transfer unit 20 in the image forming apparatus 100 in the first preferred embodiment. In other words, the image forming apparatus 200 in the second preferred embodiment neither requires a user (operator) to perform an operation for which a user has be trained, nor troublesome readjustment, when the intermediary transfer unit 20 needs to be replaced; the intermediary transfer unit 20 in the image forming apparatus 200 can be easily replaced.

Further, the image forming apparatus 200 is not structured so that the pre-transfer density level detection unit 60 is put back into the normal position by the movement of the intermediary transfer unit 20, which occurs when the intermediary transfer unit 20 is mounted (remounted). Therefore, the pre-transfer density level detection unit 60 can be rotationally moved independently from the intermediary transfer unit 20 while the door unit 61 is open. In other words, the pre-transfer density level detection unit 60 can be rotationally moved without moving the intermediary transfer unit 20 out of the image forming apparatus 200, as long as the door unit 61 is open. Therefore, the image forming apparatus 200 is superior to the image forming apparatus 100 in terms of the maintainability of the pre-transfer density level detection unit 60.

In the second preferred embodiment, the pre-transfer density level detection unit 60 is moved back into the preset position by the closing movement of the door unit 61. Therefore, the image forming apparatus 200 in the second preferred embodiment is superior to the image forming apparatus 100 in the first preferred embodiment in terms of the replaceability of the intermediary transfer unit 20. Further, in the second preferred embodiment, even if the door unit 61 is closed while the pre-transfer density level detection unit 60 is in its retreat, because a user (operator) forgot to put the pre-transfer density level detection unit 60 back into its normal position after the user inspected or repaired the pre-transfer density level detection unit 60, or carried out the like operation, the pre-transfer density level detection unit 60 is automatically put back into its normal position by the closing movement of the door unit 61. Therefore, even if the image forming apparatus 200 is started after the user forgot to put the pre-transfer density level detection unit 60 back into its normal position, no trouble occurs. In other words, the image forming apparatus 200 is superior to even the image forming apparatus 100 in the first preferred embodiment in terms of maintainability.

As described above, in the case of an image forming apparatus in accordance with the present invention, its main assembly is structured so that its intermediary transfer unit can be pulled out of the main assembly through the opening which can be created by separating one part of the main assembly from the rest of the main assembly by rotationally moving the one part of the main assembly about its rotational axis. Further, the detecting member detects the toner image on the intermediary transfer member during an image forming operation, when it is in the path through which the intermediary transfer unit is pulled out of the main assembly.

However, when the intermediary transfer unit is pulled out through the abovementioned opening, the detecting member moving mechanism moves the detecting member into a position in which the detecting member does not interfere with the removal of the intermediary transfer unit, nor is the performance of the detecting member affected by the movement of the intermediary transfer unit.

Therefore, an operation such as the operation for removing the detecting member or moving the detecting member out of the intermediary transfer unit path before the intermediary transfer unit is pulled out, is unnecessary. In other words, the present invention can simplify the procedure for pulling out, or remounting, the intermediary transfer unit, making it possible to reduce the number of operational errors and the troubles attributable to the operational errors.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 246234/2007 filed Sep. 21, 2007 which is hereby incorporated by reference.

What is claimed is:

1. An image forming apparatus comprising:

a plurality of image bearing members;

a plurality of primary transferring devices for transferring toner images from said image bearing members onto an intermediary transfer belt provided above said plurality of image bearing members;

an intermediary transfer unit including said intermediary transfer belt;

a secondary transfer portion for transferring the toner image from said intermediary transfer belt onto a recording material;

a detecting member for detecting the toner image formed on said intermediary transfer belt;

an adjusting device for adjusting a condition under which the image is formed on said image bearing member on the basis of a result of detection of said detecting member;

an openable member for opening an opening portion provided in said image forming apparatus;

a guiding mechanism for guiding draw of said intermediary transfer unit toward said opening portion when said openable member opens; and a retracting mechanism for retracting said detecting member away from said intermediary transfer unit with movement of said intermediary transfer unit toward said opening portion.

2. The apparatus according to claim 1, wherein said detecting member is disposed opposed to said intermediary transfer belt at a position downstream of said plurality of image bearing members and upstream of said secondary transfer portion.

3. The apparatus according to claim 1, further comprising a stretching member for stretching said intermediary transfer belt, wherein said retracting mechanism rotates said detecting member about a rotational axis which is in parallel with said stretching member.

4. The apparatus according to claim 1, further comprising a stretching member for stretching said intermediary transfer belt, wherein said detecting member detects said intermediary transfer belt in a range where said intermediary transfer belt is in contact with said stretching member, and said retracting mechanism includes a contact member for positioning said detecting member to said stretching member by contacting to a circumference co axial with said stretching member at least at two positions.

5. The apparatus according to claim 1, further comprising a stretching member for stretching said intermediary transfer belt, wherein said intermediary transfer unit includes an opposing roller supporting said intermediary transfer belt at an inside of intermediary transfer belt and forming the secondary transfer portion, above said stretching member.

6. The apparatus according to claim 1, further comprising a fixing unit for fixing the toner image on the recording material.

7. The apparatus according to claim 1, further comprising a first stretching member for stretching said intermediary transfer belt, wherein said intermediary transfer unit includes an opposing roller supporting said intermediary transfer belt at an inside of said intermediary transfer belt and forming the secondary transfer portion, above said first stretching member, and a second stretching member at a position opposite to said first stretching member to provide a downward facing travel of said intermediary transfer belt, wherein said intermediary transfer unit poses such that second stretching member is at a position upper than said first stretching member to downwardly incline the downward facing travel toward said first stretching member, and said fixing unit is disposed at a fixed position lower than said second stretching member, and wherein said guiding mechanism guides said intermediary transfer unit below said fixing means.

8. The apparatus according to claim 1, further comprising a resetting mechanism for restoring said detecting member to a detecting position thereof with resetting of said retracting mechanism.

9. An image forming apparatus comprising:

a plurality of image bearing members;

a plurality of primary transferring devices for transferring toner images from said plurality of image bearing members onto an intermediary transfer belt;

an intermediary transfer unit including said intermediary transfer belt;

a secondary transfer portion for transferring the toner image from said intermediary transfer belt onto a recording material;

a detecting unit for detecting the toner image formed on said intermediary transfer belt in a detecting position;

an adjusting device for adjusting a condition under which the image is formed on said image bearing member on the basis of a result of detection of said detecting unit;

a covering member for opening an opening portion provided in said image forming apparatus;

a guiding member for guiding said intermediary transfer unit toward said opening portion for removal of said intermediary transfer unit; and a moving mechanism for moving, with a removing operation of said intermediary transfer unit, said detecting unit from the detecting position to a retracted position in which said detecting unit does not interfere with a locus of said intermediary transfer unit moving for removal thereof from said apparatus.

10. The apparatus according to claim 9, wherein in said detecting position, said detecting unit interferes with a locus of said intermediary transfer unit moving for removal thereof from said apparatus.

11. The apparatus according to claim 9, further comprising a stretching member for stretching said intermediary transfer belt, wherein said detecting unit includes a detecting member and a supporting member for supporting said detecting member, and wherein said supporting member contacts to said stretching member for positioning said detecting unit by contacting to a circumference co axial with said stretching member at least at two positions.

12. The apparatus according to claim 11, wherein said detecting member detects the toner image formed on said intermediary transfer belt in a range where said intermediary transfer belt is in contact with said stretching member.

13. The apparatus according to claim 11, wherein when said detecting unit is in the detecting position, said supporting member is in contact with said stretching member, and when said detecting unit is in the retracted position, said supporting member is spaced away from said stretching member.

14. The apparatus according to claim 13, wherein said detecting unit is moved from the detecting position to the retracted position by a force applied from said intermediary transfer unit with the removing operation of said intermediary transfer unit.

15. The apparatus according to claim 9, wherein said detecting unit is moved from the retracted position to the detecting position by a force applied from said covering member with a closing operation of said cover member.

16. The apparatus according to claim 15, wherein said covering member is provided with a contact member contactable to said detecting unit placed in the detecting position when said covering member is closed, and a pressing member for pressing said contact member to urge said detecting unit placed in the detecting position toward said stretching member.

* * * * *